US009031491B2

(12) United States Patent
Asano et al.

(10) Patent No.: US 9,031,491 B2
(45) **Date of Patent: *May 12, 2015**

(54) IMAGE FORMING APPARATUS AND PROCESS CARTRIDGE

(71) Applicant: Ricoh Company, Ltd., Tokyo (JP)

(72) Inventors: Tomoharu Asano, Shizuoka (JP); Hideo Nakamori, Shizuoka (JP); Akihiro Sugino, Shizuoka (JP); Noboru Toriu, Shizuoka (JP); Keisuke Shimoyama, Shizuoka (JP); Mitsuaki Hirose, Shizuoka (JP); Yohta Sakon, Kanagawa (JP); Masahiro Ohmori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 53 days.

This patent is subject to a terminal disclaimer.

(21) Appl. No.: 13/765,090

(22) Filed: Feb. 12, 2013

(65) Prior Publication Data

US 2013/0251401 A1 Sep. 26, 2013

(30) Foreign Application Priority Data

Mar. 8, 2012 (JP) ..... 2012-052050
Dec. 28, 2012 (JP) ..... 2012-287706

(51) Int. Cl.
*G03G 21/00* (2006.01)
*G03G 21/18* (2006.01)
*G03G 5/147* (2006.01)

(52) U.S. Cl.
CPC .. *G03G 21/1814* (2013.01); *G03G 2215/00957* (2013.01); *G03G 2221/183* (2013.01); *G03G 5/14734* (2013.01); *G03G 5/14791* (2013.01); *G03G 5/14795* (2013.01)

(58) Field of Classification Search
USPC ..... 399/350
See application file for complete search history.

(56) References Cited

U.S. PATENT DOCUMENTS

| | | | | |
|---|---|---|---|---|
| 2002/0115005 | A1 | 8/2002 | Ikuno et al. | |
| 2005/0266325 | A1* | 12/2005 | Yanagawa et al. | 430/58.7 |
| 2009/0311017 | A1* | 12/2009 | Ohmori et al. | 399/350 |
| 2011/0135361 | A1* | 6/2011 | Kabata et al. | 399/350 |
| 2011/0217102 | A1* | 9/2011 | Ohmori et al. | 399/350 |

FOREIGN PATENT DOCUMENTS

| | | |
|---|---|---|
| JP | 1-205171 | 8/1989 |
| JP | 7-333881 | 12/1995 |
| JP | 8-015887 | 1/1996 |
| JP | 8-123053 | 5/1996 |
| JP | 8-146641 | 6/1996 |

(Continued)

*Primary Examiner* — Ryan Walsh
(74) *Attorney, Agent, or Firm* — Cooper & Dunham LLP

(57) ABSTRACT

An image forming apparatus, including a photoreceptor; a charger; an irradiator; an image developer; a transferer; a fixer; and a cleaning blade formed of a strip-shaped elastic blade, removing a powder from the surface of the photoreceptor passing an edge line of the blade while contacting thereto, wherein the photoreceptor includes a crosslinked resin surface layer formed of at least one of an acrylic resin and a methacrylic resin, and the cleaning blade includes a contact point with the photoreceptor, including a substrate; a mixed layer formed of at least one of an acrylic resin and a methacrylic resin, located at the surface of the substrate; and a surface layer formed of at least one of an acrylic resin and a methacrylic resin, located on the surface of the substrate.

7 Claims, 7 Drawing Sheets

(56) References Cited

FOREIGN PATENT DOCUMENTS

| | | |
|---|---|---|
| JP | 9-127846 | 5/1997 |
| JP | 2000-005171 | 1/2000 |
| JP | 2002-341571 | 11/2002 |
| JP | 2004-233818 | 8/2004 |
| JP | 2004-233881 | 8/2004 |
| JP | 2010-191378 | 9/2010 |
| JP | 2011-138110 | 7/2011 |
| JP | 2011-145457 | 7/2011 |
| JP | 2011-164455 | 8/2011 |
| JP | 2012-083729 | 4/2012 |

* cited by examiner

PROJECTED IMAGE OF PARTICLE PERIPHERAL LENGTH: C1

AREA: S

CIRCLE WITH AREA OF S PERIPHERAL LENGTH: C2

AREA: S

IMAGE FORMING APPARATUS AND PROCESS CARTRIDGE

CROSS-REFERENCE TO RELATED APPLICATIONS

This patent application is based on and claims priority pursuant to 35 U.S.C. §119 to Japanese Patent Applications Nos. 2012-052050 and 2012-287706, filed on Mar. 8, 2012 and Dec. 28, 2012, respectively, in the Japan Patent Office, the entire disclosure of which is hereby incorporated by reference herein.

BACKGROUND OF THE INVENTION

1. Field of the Invention

The present invention relates to an image forming apparatus and a process cartridge.

2. Description of the Related Art

In electrophotographic image forming apparatuses, residual toner remaining on the surface of a photoreceptor even after a toner image thereon is transferred onto a recording material or an intermediate transfer medium is removed therefrom using a cleaner.

Strip-shaped cleaning blades made of an elastic material such as polyurethane rubbers are typically used for such a cleaner because of having advantages such that the cleaner has simplified structure and good cleanability. Among such cleaning blades, a cleaning blade in which one end thereof is supported by a supporter, and an edge of the other end is contacted with a surface of a photoreceptor to block and scrape off residual toner on the photoreceptor, thereby removing the residual toner from the surface of the photoreceptor.

In attempting to meet a recent need of forming high quality images, there are image forming apparatuses using spherical toner (hereinafter referred to as polymerization toner), which has a relatively small particle diameter and which is prepared by a method such as polymerization methods. Since such polymerization toner has such an advantage as to have a higher transfer efficiency than pulverization toner, which has been conventionally used, the polymerization toner can meet the need. However, polymerization toner has such a drawback as not to be easily removed from a photoreceptor by a cleaning blade. This is because such polymerization toner has a spherical form and a small particle diameter, and easily passes through a small gap between the tip of a cleaning blade and the surface of a photoreceptor.

In attempting to prevent polymerization toner from passing through a gap between a cleaning blade and a photoreceptor, it is necessary to increase the pressure to the cleaning blade contacted with the surface of the photoreceptor to enhance the cleanability of the cleaning blade. However, when the contact pressure of the cleaning blade is increased, the friction between the cleaning blade and the photoreceptor is increased, and thereby the tip of the cleaning blade is pulled by the photoreceptor in the moving direction of the photoreceptor. Specifically, as illustrated in FIG. 8(*a*), a cleaning blade 62 is pulled by the surface of an photoreceptor 123 in a moving direction (indicated by an arrow) of the photoreceptor due to increase of friction between the blade and the photoreceptor, thereby causing a problem (hereinafter referred to as everted-tip problem) in that an edge 62*c* of a tip 62*a* of the blade 62 is everted. In this regard, the thus everted tip has a restoring force, and therefore the tip tends to vibrate, resulting in generation of fluttering sounds.

In addition, when the cleaning operation is continued while the edge 62*c* of the cleaning blade 62 is everted, a portion of the tip 62*a* of the cleaning blade 62, which is apart from the edge 62*c* by few micrometers, is abraded as illustrated in FIG. 8(*b*). When the cleaning blade 62 is further used for the cleaning operation, the portion of the tip 62*a* of the blade 62 is further abraded, resulting in lack of the edge 62*c* of the blade 62 as illustrated in FIG. 8(*c*). The cleaning blade 62 having no edge cannot remove residual toner from the surface of the photoreceptor 123, thereby forming an abnormal image in which background thereof is soiled with residual toner.

In attempting to prevent occurrence of the problem, Japanese Patent No. JP-3602898-B1 (Japanese published unexamined application No. JP-H09-127846-A) discloses a cover layer made of a resin, which is harder than a rubber and has a pencil hardness of from B to 6H, is formed at least on the edge of the tip of a cleaning blade made of a polyurethane elastomer. It is described therein that by forming such a cover layer, friction between the tip of the cleaning blade and a surface of a photoreceptor can be reduced while enhancing the abrasion resistance of the cleaning blade. In addition, it is described therein that since the cover layer is hard and is not easily deformed, occurrence of the everted-tip problem can be prevented.

Further, in attempting to prevent occurrence of the everted-tip problem, Japanese published unexamined application No. JP-2004-233818-A discloses a blade impregnated with an ultraviolet crosslinkable material including a silicone so as to be swelled is exposed to ultraviolet rays so that the surface of the blade is covered with the crosslinked material, which is harder than rubbers and has good abrasion resistance. In addition, Japanese published unexamined application No. JP-2011-138110-A discloses a cleaning blade formed by impregnating the surface thereof with an acrylate polymer at a depth of from 5 to 100 μm, layering the acrylate polymer thereon and irradiating the acrylate polymer with an ultraviolet to be crosslinked. It is described therein that by covering the surface of the cleaning blade with an ultraviolet crosslinked material having higher hardness than the elastic blade, the abrasion resistance of the cleaning blade can be enhanced. In addition, it is described therein that since the surface portion of the blade is made of a combination of a rubber and a crosslinked material and has higher hardness than a rubber, the hard portion of the blade can be normally contacted with a photoreceptor even when the blade is used over a long period of time and the cover layer of the blade is abraded, resulting in prevention of serious abrasion of the blade and generation of fluttering sounds.

However, even when the above-mentioned cleaning blades are used, occurrence of the above-mentioned problems is hardly prevented if images having a high image area proportion (such as image having large solid images) are continuously produced (i.e., if the amount of residual toner on a photoreceptor to be removed by the cleaning blade is large). The reason is considered to be as follows.

Specifically, since the blade has a cover layer on the tip thereof or includes a crosslinked material in a surface portion thereof in the longitudinal direction thereof, the elastic property of the rubber of the blade tends to deteriorate. When the elastic property of the blade is deteriorated, the blade cannot be satisfactorily contacted with the surface of a photoreceptor (i.e., the pressure of the blade to a photoreceptor varies) if the photoreceptor is eccentric or the surface thereof is waved. In addition, when images having high image area proportions are continuously produced and a large amount of residual toner is present on the surface of the photoreceptor, the large amount of toner is collected at the tip of the blade by being blocked by the blade. In this case, the residual toner at the tip of the blade tends to pass through a relatively large gap formed between a portion of the blade and the surface of the photoreceptor, which are contacted with each other at a relatively low pressure due to eccentricity of the photoreceptor or waving of the surface thereof, resulting in occurrence of the above-mentioned abnormal image problem.

In the cleaning blade disclosed in Japanese Patent No. JP-3602898-B1 (Japanese published unexamined application No. JP-H09-127846-A), when a thick cover layer made of a material having high hardness is formed, the elastic property of the rubber constituting the blade is deteriorated by the rigid cover layer, and thereby the blade cannot be satisfactorily contacted with the surface of a photoreceptor (i.e., the pressure of the blade to a photoreceptor varies). Therefore, the cover layer is preferably as thin as possible. However, when a thin cover layer is formed, the cover layer is easily worn out and the rubber is exposed after a short period of time, resulting in occurrence of the above-mentioned everted-tip problems.

In addition, the cleaning blades disclosed in Japanese published unexamined applications Nos. JP-2004-233838-A and JP-2011-138110-A have the following drawback. Specifically, in order to impart the same hardness as that of the cover layer of the first mentioned cleaning blade to the surface of the crosslinked material-impregnated cleaning blade, it is necessary that the blade is impregnated with a large amount of ultraviolet crosslinkable material to such an extent that the surface of the blade is covered with the crosslinkable material. In this case, the ultraviolet crosslinkable material penetrates into an inner portion of the blade. When ultraviolet rays irradiate the blade to crosslink the ultraviolet crosslinkable material, the material-impregnated portion of the blade, which has a considerable thickness, becomes too hard, thereby deteriorating the elasticity of the rubber (blade), resulting in occurrence of the above-mentioned abnormal problem. In contrast, when the blade is impregnated with a small amount of ultraviolet crosslinkable material to maintain the elasticity of the blade, the rubber of the blade is not perfectly covered with the crosslinked material (i.e., the surface portion is constituted of a combination of the rubber and the crosslinked material), and therefore the surface portion has lower hardness than the cover layer of the first-mentioned blade. In addition, friction between the surface of the blade and a surface of a photoreceptor cannot be satisfactorily decreased, thereby causing the above-mentioned everted-tip problem. Further, the photoreceptor has a surface layer abrasion problem and the fluttering sound problem.

As a method of preventing the surface layer abrasion and the fluttering sound of a photoreceptor, a combination with a photoreceptor having improved durability is available. As a method of increasing the abrasion resistance of a photoreceptor, methods of forming a crosslinked resin on the surface thereof are disclosed in Japanese published unexamined applications Nos. JP-H01-205171-A, JP-H07-333881-A, JP-H08-15887-A, JP-H08-123053-A, JP-H08-146641-A and JP-2011-145457-A, and Japanese Patents Nos. JP-3734735-B1 and JP-4443837-B1 (Japanese published unexamined applications Nos. JP-2002-341571-A and JP-2004-233881-A).

A combination of a cleaning blade coated with an UV curable resin and a durability-improved photoreceptor using a crosslinkable charge transport material in its surface layer is disclosed in Japanese published unexamined application No. JP-2010-191378-A.

This prevents initial abrasion of the cleaning blade and the surface of the photoreceptor, and the fluttering sound. However, only mechanical durability thereof is improved and cleanability required in recent electrophotographic process is not sufficiently improved. Particularly when they are used for long periods, a microscopic gap is formed therebetween because of a slight abrasion therebetween, and a toner scrapes through the gap, resulting in production of abnormal images.

Because of these reasons, a need exist for a cleaning blade which has good abrasion resistance and which can be satisfactorily contacted with a surface of a photoreceptor at substantially a constant pressure to satisfactorily perform a cleaning operation without causing the fluttering sound problem and the everted-tip problem.

SUMMARY OF THE INVENTION

Accordingly, one object of the present invention to provide a cleaning blade which has good abrasion resistance and which can be satisfactorily contacted with a surface of a photoreceptor at substantially a constant pressure to satisfactorily perform a cleaning operation without causing the fluttering sound problem and the everted-tip problem.

Another object of the present invention to provide an image forming apparatus using the cleaning blade.

A further object of the present invention to provide a process cartridge used in the image forming apparatus.

These objects and other objects of the present invention, either individually or collectively, have been satisfied by the discovery of an image forming apparatus, comprising:

a photoreceptor;

a charger configured to charge the surface of the photoreceptor;

an irradiator configured to irradiate the surface thereof to form an electrostatic latent image thereon;

an image developer configured to develop the electrostatic latent image with a toner to form a toner image;

a transferer configured to transfer the toner image onto a recording medium;

a fixer configured to fix the toner image on the recording medium; and a cleaning blade formed of a strip-shaped elastic blade, configured to remove a powder from the surface of the photoreceptor passing an edge line of the blade while contacting thereto, wherein the photoreceptor comprises a crosslinked resin surface layer formed of at least one of an acrylic resin and a methacrylic resin, and the cleaning blade comprises a contact point with the photoreceptor, comprising:

a substrate;

a mixed layer formed of at least one of an acrylic resin and a methacrylic resin, located at the surface of the substrate; and a surface layer formed of at least one of an acrylic resin and a methacrylic resin, located on the surface of the substrate.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a cleaning blade which has good abrasion resistance and which can be satisfactorily contacted with a surface of a photoreceptor at substantially a constant pressure to satisfactorily perform a cleaning operation without causing the fluttering sound problem and the everted-tip problem.

More particularly, the present invention relates to an image forming apparatus, comprising:

a photoreceptor;

a charger configured to charge the surface of the photoreceptor;

an irradiator configured to irradiate the surface thereof to form an electrostatic latent image thereon;

an image developer configured to develop the electrostatic latent image with a toner to form a toner image;

a transferer configured to transfer the toner image onto a recording medium;

a fixer configured to fix the toner image on the recording medium; and a cleaning blade formed of a strip-shaped elastic blade, configured to remove a powder from the surface of the photoreceptor passing an edge line of the blade while contacting thereto, wherein the photoreceptor comprises a crosslinked resin surface layer formed of at least one of an acrylic resin and a methacrylic resin, and the cleaning blade comprises a contact point with the photoreceptor, comprising:

a substrate;

a mixed layer formed of at least one of an acrylic resin and a methacrylic resin, located at the surface of the substrate; and a surface layer formed of at least one of an acrylic resin and a methacrylic resin, located on the surface of the substrate.

Initially, an example of the image forming apparatus of this disclosure will be described by reference to drawings.

Figure 2:
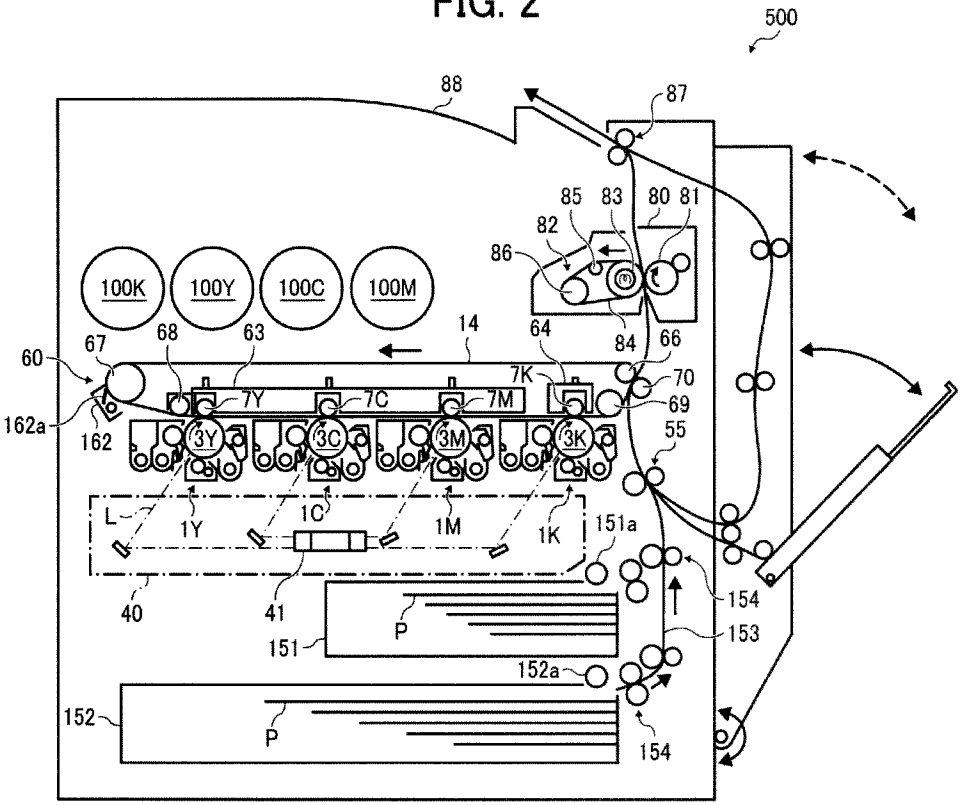
FIG. 2 is a schematic cross-sectional view illustrating an example of the image forming apparatus of this disclosure.

FIG. 2 illustrates an electrophotographic printer as an example of the image forming apparatus of this disclosure.

Referring to FIG. 2, a printer 500 includes four image forming units, i.e., yellow (Y), cyan (C), magenta (M) and black (K) image forming units 1Y, 1C, 1M and 1K. The four image forming units 1Y, 1C, 1M and 1K have the same configuration except that the color of toner used for developing an electrostatic latent image on a photoreceptor is different.

The printer 500 further includes a transfer unit 60, which includes an intermediate transfer belt 14 and which is located above the four image forming units 1. As mentioned later in detail, Y, C, M and K toner images formed on respective photoreceptors 3Y, 3C, 3M and 3K serving as photoreceptors are transferred onto the surface of the intermediate transfer belt 14 so as to be overlaid, resulting in formation of a combined color toner image on the intermediate transfer belt 14.

In addition, an optical writing unit 40 serving as a latent image former is located below the four image forming units 1. The optical writing unit 40 emits light beams L (such as laser beams) based on Y, C, M and K image information to irradiate the photoreceptors 3Y, 3C, 3M and 3K with the laser beams L, thereby forming electrostatic latent images, which respectively correspond to the Y, C, M and K images to be formed, on the photoreceptors. The optical writing unit 40 includes a polygon mirror 41, which is rotated by a motor and which reflects the light beams L emitted by a light source of the optical writing unit while deflecting the laser beams to irradiate the photoreceptors 3Y, 3C, 3M and 3K with the laser beams L via optical lenses and minors. The optical writing unit 40 is not limited thereto, and an optical writing unit using a LED array or the like can also be used therefor.

Below the optical writing unit 40, a first sheet cassette 151, and a second sheet cassette 152 are arranged so that the first sheet cassette is located above the second sheet cassette. Each of the sheet cassettes 151 and 152 contains a stack of paper sheets P serving as a recording material. Uppermost sheets of the paper sheets Pin the first and second sheet cassettes 151 and 152 are contacted with a first feed roller 151*a* and a second feed roller 152*a*, respectively. When the first feed roller 151*a* is rotated (counterclockwise in FIG. 2) by a driver (not shown), the uppermost sheet P in the first sheet cassette 151 is fed by the first feed roller 151*a* toward a sheet passage 153 located on the right side of the printer 500 while extending vertically. Similarly, when the second feed roller 152*a* is rotated (counterclockwise in FIG. 2) by a driver (not shown), the uppermost sheet Pin the second sheet cassette 152 is fed by the second feed roller 152*a* toward the sheet passage 153.

Plural pairs of feed rollers 154 are arranged in the sheet passage 153. The paper sheet P fed into the sheet passage 153 is fed from the lower side of the sheet passage 153 to the upper side thereof while being pinched by the pairs of feed rollers 154.

A pair of registration rollers 55 is arranged on the downstream side of the sheet passage 153 relative to the sheet feeding direction. When the pair of registration rollers 55 pinches the tip of the paper sheet P thus fed by the pairs of feed rollers 154, the pair of registration rollers 55 is stopped once, and is then rotated again to timely feed the paper sheet P to a secondary transfer nip mentioned below so that a combined color toner image on the intermediate transfer belt 14 is transferred onto the predetermined position of the paper sheet P.

Figure 3:
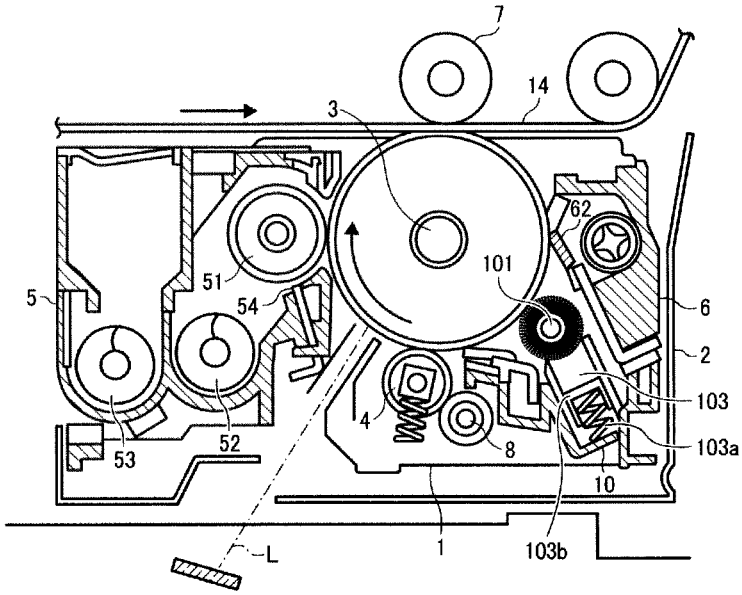
FIG. 3 is a schematic cross-sectional view illustrating an image forming unit of the image forming apparatus illustrated in FIG. 2.

FIG. 3 illustrates one of the four image forming units 1. As illustrated in FIG. 3, the image forming unit 1 includes a drum-shaped photoreceptor 3 serving as a photoreceptor. The shape of the photoreceptor 3 is not limited thereto, and sheet-shaped photoreceptors, endless belt-shaped photoreceptors and the like can also be used.

Around the photoreceptor 3, a charging roller 4, an image developer 5, a primary transfer roller 7, a cleaner 6, a lubricant applicator 10, a discharging lamp (not shown), etc., are arranged. The charging roller 4 serves as a charger for charging a surface of the photoreceptor 3. The image developer 5 serves as an image developer for developing an electrostatic latent image formed on the photoreceptor 3 with a developer to form a toner image thereon. The primary transfer roller 7 serves as a primary transferer for transferring the toner image on the photoreceptor 3 to the intermediate transfer belt 14. The cleaner 6 serves as a cleaner for removing residual toner from the surface of the photoreceptor 3 after transferring the toner image. The lubricant applicator 10 serves as a lubricant applicator for applying a lubricant to the surface of the photoreceptor 3 after cleaning the surface. The discharging lamp (not shown) serves as a discharger for decaying residual charges remaining on the surface of the photoreceptor 3 after cleaning the surface.

The charging roller 4 is arranged in the vicinity of the photoreceptor 3 with a predetermined gap therebetween, and evenly charges the photoreceptor 3 so that the photoreceptor 3 has a predetermined potential with a predetermined polarity. The thus evenly charged surface of the photoreceptor 3 is irradiated with the light beam L emitted by the optical writing unit 40 based on image information, thereby forming an electrostatic latent image on the surface of the photoreceptor 3.

The image developer 5 has a developing roller 51 serving as a developer bearing member. A development bias is applied to the developing roller 51 by a power source (not shown). A supplying screw 52 and an agitating screw 53 are provided in a casing of the image developer 5 to feed the developer in opposite directions in the casing so that the developer is charged so as to have a charge with a predetermined polarity. In addition, a doctor 54 is provided in the image developer to form a developer layer having a predetermined thickness on the surface of the developing roller 51. The layer of the developer, which has been charged so as to have a charge with the predetermined polarity, is adhered to an electrostatic latent image on the photoreceptor 3 at a development region, in which the developing roller 51 is opposed to the photoreceptor 3, resulting in formation of a toner image on the surface of the photoreceptor 3.

The cleaner 6 includes a fur brush 101, the cleaning blade 62, etc. The cleaning blade 62 is contacted with the surface of the photoreceptor 3 in such a manner as to counter the rotated photoreceptor 3. The cleaning blade 62 will be described later in detail.

The lubricant applicator 10 includes a solid lubricant 103, and a pressing spring 103*a* to press the solid lubricant 103 toward the fur brush 101 serving as a lubricant applicator to apply the lubricant to the surface of the photoreceptor 3. The solid lubricant 103 is supported by a bracket 103*b* while being pressed toward the fur brush 101 by the pressing spring 103*a*. The solid lubricant 103 is scraped by the fur brush 101, which is driven by the photoreceptor 3 so as to rotate (counterclockwise in FIG. 3), thereby applying the lubricant 103 to the surface of the photoreceptor 3. By thus applying the lubricant, the friction coefficient of the surface of the photoreceptor 3 can be controlled so as to be not higher than 0.2.

Although the non-contact short-range charging roller 4 is used as the charger of the image forming unit 1, the charger is not limited thereto, and contact chargers (such as contact charging rollers), corotrons, scorotrons, solid state chargers, and the like can also be used for the charger. Among these chargers, contact chargers, and non-contact short-range chargers are preferable because of having advantages such that the charging efficiency is high, the amount of ozone generated in a charging operation is small, and the charger can be miniaturized.

Specific examples of light sources for use in the optical writing unit 40 and the discharge lamp include any known light emitters such as fluorescent lamps, tungsten lamps, halogen lamps, mercury lamps, sodium lamps, light emitting diodes (LEDs), laser diodes (LDs), electroluminescent lamps (ELs), and the like.

In order to irradiate the photoreceptor 3 with light having a wavelength in a desired range, sharp cut filters, bandpass filters, infrared cut filers, dichroic filters, interference filters, color temperature converting filters, and the like can be used.

Among these light sources, LEDs and LDs are preferably used because of having advantages such that the irradiation energy is high, and light having a relatively long wavelength of from 600 to 800 nm can be emitted.

The transfer unit 60 serving as a transferer includes not only the intermediate transfer belt 14, but also a belt cleaning unit 162, a first bracket 63, and a second bracket 64. In addition, the transfer units 60 further includes four primary transfer rollers 7Y, 7C, 7M and 7K, a secondary transfer backup roller 66, a driving roller 67, a supplementary roller 68, and a tension roller 69. The intermediate transfer belt 14 is rotated counterclockwise in an endless manner by the driving roller 67 while being tightly stretched by the four rollers. The four primary transfer rollers 7Y, 7C, 7M and 7K press the thus rotated intermediate transfer belt 14 toward the photoreceptors 3Y, 3C, 3M and 3K, respectively, to form four primary transfer nips. In addition, a transfer bias having a polarity opposite that of the charge of the toner is applied to the backside (i.e., inner surface) of the intermediate transfer belt (for example, a positive bias is applied when a negative toner is used). Since the intermediate transfer belt 14 is rotated endlessly, yellow, cyan, magenta and black toner images, which are formed on the photoreceptors 3Y, 3C, 3M and 3K, respectively, are sequentially transferred onto the intermediate transfer belt 14 so as to be overlaid, resulting in formation of a combined color toner image on the intermediate transfer belt 14.

The secondary transfer backup roller 66 and a secondary transfer roller 70 sandwich the intermediate transfer belt 14 to form a secondary transfer nip. As mentioned above, the pair of registration rollers 55 pinches the transfer paper sheet P once, and then timely feeds the paper sheet P toward the secondary transfer nip so that the combined color toner image on the intermediate transfer belt 14 is transferred onto a predetermined position of the paper sheet P. Specifically, the entire combined color toner image is transferred due to a secondary transfer electric field formed by the secondary transfer roller 70, to which a secondary transfer bias is applied, and the secondary transfer backup roller 66, and a nip pressure applied between the secondary transfer roller 70 and the transfer backup roller 66, resulting in formation of a full color toner image on the paper sheet P having white color.

After passing the secondary transfer nip, the intermediate transfer belt 14 bears residual toners (i.e., non-transferred toners) on the surface thereof. The belt cleaning unit 162 removes the residual toners from the surface of the intermediate transfer belt 14. Specifically, a belt cleaning blade 162*a* of the belt cleaning unit 162 is contacted with the surface of the intermediate transfer belt 14 to remove the residual toners therefrom.

The first bracket 63 of the transfer unit 60 is rotated at a predetermined rotation angle on a rotation axis of the supplementary roller 68 by being driven by an on/off operation of a solenoid (not shown). When a monochromatic image is formed, the printer 500 slightly rotates the first bracket 63 counterclockwise by driving the solenoid. When the first bracket 63 is thus rotated, the primary transfer rollers 7Y, 7C and 7M are moved counterclockwise around the rotation axis of the supplementary roller 68, thereby separating the intermediate transfer belt 14 from the photoreceptors 3Y, 3C and 3M. Thus, only the black image forming unit 1K is operated (without driving the color image forming units 1Y, 1C and 1M) to form a monochromatic image. By using this method, the life of the parts of the color image forming units 1Y, 1C and 1M can be prolonged.

As illustrated in FIG. 2, a fixing unit 80 is provided above the secondary transfer nip. The fixing unit 80 includes a pressure/heat roller 81 having a heat source (such as a halogen lamp) therein, and a fixing belt unit 82. The fixing belt unit 82 includes an endless fixing belt 84 serving as a fixing member, a heat roller 83 having a heat source (such as a halogen lamp) therein, a tension roller 85, a driving roller 86, a temperature sensor (not shown), and the like. The endless fixing belt 84 is counterclockwise rotated endlessly by the driving roller 86 while being tightly stretched by the heat roller 83, the tension roller 85 and the driving roller 86. When the fixing belt 84 is rotated, the fixing belt is heated by the heat roller 83 from the backside thereof. The pressure/heat roller 81 is contacted with the front surface of the fixing belt 84 while pressing the fixing belt 84 to the heat roller 83, resulting in formation of a fixing nip between the pressure/heat roller 81 and the fixing belt 84.

A temperature sensor (not shown) is provided so as to be opposed to the front surface of the fixing belt 84 with a predetermined gap therebetween to detect the temperature of the fixing belt 84 at a location just before the fixing nip. The detection data are sent to a fixing device supply circuit (not shown). The fixing device supply circuit performs ON/OFF control on the heat source in the heat roller 83 and the heat source in the pressure/heat roller 81.

The transfer paper sheet P passing the secondary transfer nip and separated from the intermediate transfer belt 14 is fed to the fixing unit 80. When the paper sheet P bearing the unfixed full color toner image thereon is fed from the lower side of the fixing unit 80 to the upper side thereof while being sandwiched by the fixing belt 14 and the pressure/heat roller 81, the paper sheet P is heated by the fixing belt 84 while being pressed by the pressure/heat roller 81, resulting in fixation of the full color toner image on the paper sheet P.

The paper sheet P thus subjected to a fixing treatment is discharged from the main body of the printer 500 by a pair of discharging rollers 87 so as to be stacked on a surface of a stacking portion 88.

Four toner cartridges 100Y, 100C, 100M and 100K respectively containing yellow, cyan, magenta and black color toners are provided above the transfer unit 60 to supply the yellow, cyan, magenta and black color toners to the corresponding image developers 5Y, 5C, 5M and 5K of the image forming units 1Y, 1C, 1M and 1K, if desired. These toner cartridges 100Y, 100C, 100M and 100K are detachable from the main body of the printer 500 independently of the image forming units 1Y, 1C, 1M and 1K.

Next, the image forming operation of the printer 500 will be described.

Upon receipt of a print execution signal from an operating portion (not shown) such as an operation panel, predetermined voltages or currents are applied to the charging roller 4 and the developing roller 51 at predetermined times. Similarly, predetermined voltages or currents are applied to the light sources of the optical writing unit 40 and the discharging lamp. In synchronization with these operations, the photoreceptors 3 are rotated in a direction indicated by an arrow by a driving motor (not shown).

When the photoreceptors 3 are rotated, the surfaces thereof are charged by the respective charging rollers 4 so as to have predetermined potentials. Next, light beams L (such as laser beams) emitted by the optical writing unit 40 irradiate the charged surfaces of the photoreceptors 3, thereby forming electrostatic latent images on the surface of the photoreceptors 3.

The surfaces of the photoreceptors 3 bearing the electrostatic latent images are rubbed by magnetic brushes of the respective developers formed on the respective developing rollers 51. In this case, the (negatively-charged) toners on the developing rollers 51 are moved toward the electrostatic latent images by the development biases applied to the developing rollers 51, resulting in formation of color toner images on the surface of the photoreceptors 3Y, 3C, 3M and 3K.

Thus, each of the electrostatic latent images formed on the photoreceptors 3 is subjected to a reverse development treatment using a negative toner. In this example, an NIP (negative/positive: a toner adheres to a place having lower potential) developing method using a non-contact charging roller is used, but the developing method is not limited thereto.

The color toner images formed on the surfaces of the photoreceptors 3Y, 3C, 3M and 3K are primarily transferred to the intermediate transfer belt 14 so as to be overlaid, thereby forming a combined color toner image on the intermediate transfer belt 14.

The combined color toner image thus formed on the intermediate transfer belt 14 is transferred onto a predetermined portion of the paper sheet P, which is fed from the first or second cassette 151 or 152 and which is timely fed to the secondary transfer nip by the pair of registration rollers 55 after being pinched thereby. After the paper sheet P bearing the combined color toner image thereon is separated from the intermediate transfer belt 14, the paper sheet P is fed to the fixing unit 80. When the paper sheet P bearing the combined color toner image thereon passes the fixing unit 80, the combined toner image is fixed to the paper sheet P upon application of heat and pressure thereto. The paper sheet P bearing the fixed combined color toner image (i.e., a full color image) thereon is discharged from the main body of the printer 500, resulting in stacking on the surface of the stacking portion 88.

Toners remaining on the surface of the intermediate transfer belt 14 even after the combined color toner image thereon is transferred to the paper sheet P are removed therefrom by the belt cleaning unit 162.

Toners remaining on the surfaces of the photoreceptors 3 even after the color toner images thereon is transferred to the intermediate transfer belt 14 are removed therefrom by the cleaner 6. Further, the surfaces of the photoreceptors 3 are coated with a lubricant by the lubricant applicator 10, followed by a discharging treatment using a discharging lamp.

As illustrated in FIG. 3, the photoreceptor 3, the charging roller 4, the developing device 5, the cleaner 6, the lubricant applicator 10, and the like are contained in a case 2 of the image forming unit 1 of the printer 500. The image forming unit 10 is detachable attachable to the main body of the printer 500 as a single unit (i.e., process cartridge). However, the image forming unit 1 is not limited thereto, and may have a configuration such that each of the members and devices such as the photoreceptor 3, charging roller 4, developing device 5, cleaner 6, and lubricant applicator 10 is replaced with a new member or device.

Next, the toner for use in the printer 500 (i.e., the image forming apparatus of the present invention) will be described.

The toner is preferably a toner having a high circularity and a small particle diameter. Such a toner can be preferably prepared by polymerization methods such as suspension polymerization methods, emulsion polymerization methods, dispersion polymerization methods, and the like. The toner preferably has an average circularity not less than 0.97, and a volume-average particle diameter not greater than 5.5 μm to produce high resolution toner images.

The average circularity of the toner is measured using a flow particle image analyzer FPIA-2000 from Sysmex Corp. The procedure is as follows:

(1) initially, 100 to 150 ml of water, from which solid foreign materials have been removed, 0.1 to 0.5 ml of a surfactant (e.g., alkylbenzenesulfonate) and 0.1 to 0.5 g of a sample (i.e., toner) are mixed to prepare a dispersion;
(2) the dispersion is further subjected to a supersonic dispersion treatment for 1 to 3 minutes using a supersonic dispersion machine to prepare a dispersion including particles at a concentration of from 3,000 to 10,000 pieces/μl;
(3) the dispersion set in the analyzer so as to be passed through a detection area formed on a plate in the analyzer; and
(4) the particles of the sample passing through the detection area are optically detected by a CCD camera and then the shapes of the toner particles and the distribution of the shapes are analyzed with an image analyzer to determine the average circularity of the sample.

Figure 4A:
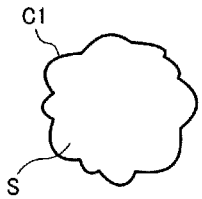
FIGS. 4A and 4B are schematic views for explaining the way to determine the circularity of toner.
Figure 4B:
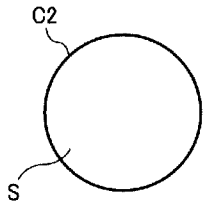

The method for determining the circularity of a particle will be described by reference to FIGS. 4A and 4B. When the projected image of a particle has a peripheral length C1 and an area S as illustrated in FIG. 4A, and the peripheral length of the circle having the same area S is C2 as illustrated in FIG. 4B, the circularity of the particle is obtained by the following equation.

$$\text{Circularity}=C2/C1$$

The average circularity of the toner is obtained by averaging circularities of particles.

The volume-average particle diameter of toner can be measured, for example, by an instrument such as COULTER MULTISIZER 2e manufactured by Beckman Coulter Inc. Specifically, the number-based particle diameter distribution data and the volume-based particle diameter distribution data are sent to a personal computer via an interface manufactured by Nikkaki Bios Co., Ltd. to be analyzed. The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl;
(2) 2 to 20 mg of a sample (toner) to be measured is added into the mixture;
(3) the mixture is subjected to an ultrasonic dispersion treatment for about 1 to 3 minutes; and
(4) the dispersion is added to 100 to 200 ml of an aqueous solution of an electrolyte in a beaker so that the mixture includes the particles at a predetermined concentration;
(5) the diluted dispersion is set in the instrument to measure particle diameters of 50,000 particles using an aperture of 100 μm to determine the volume average particle diameter.

In this regard, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm: and
(13) not less than 32.00 μm and less than 40.30 μm.

Namely, particles having a particle diameter of from 2.00 to 40.30 μm are targeted.

In this regard, the volume average particle diameter is obtained by the following equation.

$$\text{Volume average particle diameter}=\Sigma XfV/\Sigma fV,$$

wherein X represent the representative particle diameter of each channel, V represents the volume of the particle having the representative particle diameter, and f represents the number of particles having particle diameters in the channel.

Figure 8:
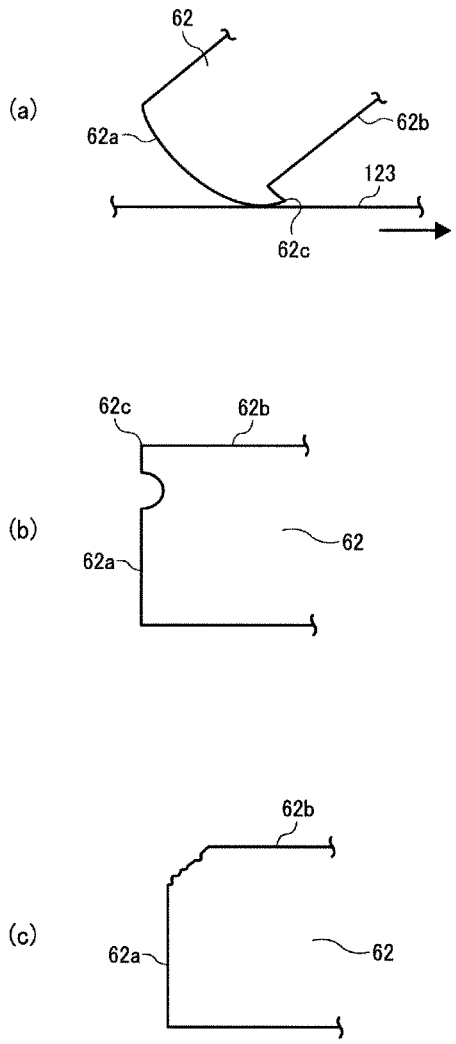
FIGS. 8(*a*) to 8(*c*) are schematic views for explaining how a cleaning blade is damaged.

When such a polymerization toner as mentioned above is used, residual toner remaining on the photoreceptor 3 cannot be satisfactorily removed therefrom using a cleaning blade compared to a case where a conventional pulverization toner is used, thereby easily forming an abnormal image in which background thereof is soiled with residual toner. In attempting to improve the cleanability (i.e., to prevent formation of such an abnormal image) by increasing the contact pressure of the cleaning blade 62 to the photoreceptor 3, another problem in that the cleaning blade is rapidly abraded is caused. In this case, friction between the cleaning blade 62 and the photoreceptor 3 is increased, and thereby the tip of the cleaning blade is pulled by the photoreceptor 3 in the moving direction of the photoreceptor as mentioned above by reference to FIG. 8(*a*). In this regard, the thus everted tip has a restoring force, and the tip tends to vibrate, resulting in generation of fluttering sounds. In addition, when the cleaning blade 62 in such a state is continuously used, the cleaning blade may lack the edge portion thereof as illustrated in FIG. 8(*c*).

Figure 1A:
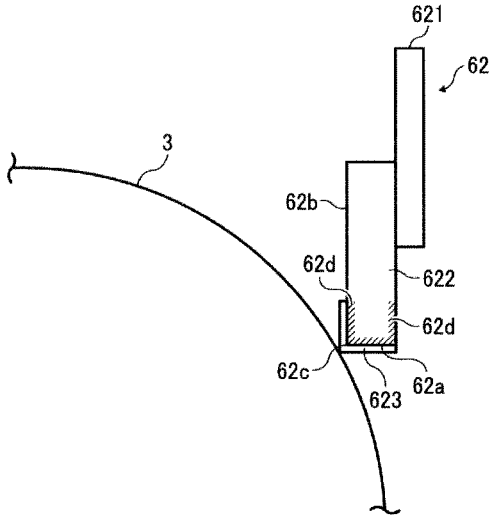
FIGS. 1A and 1B are schematic cross-sectional views illustrating an example of the cleaning blade of this disclosure.
Figure 1B:
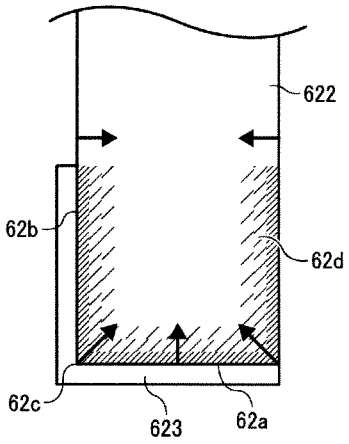
Figure 5:
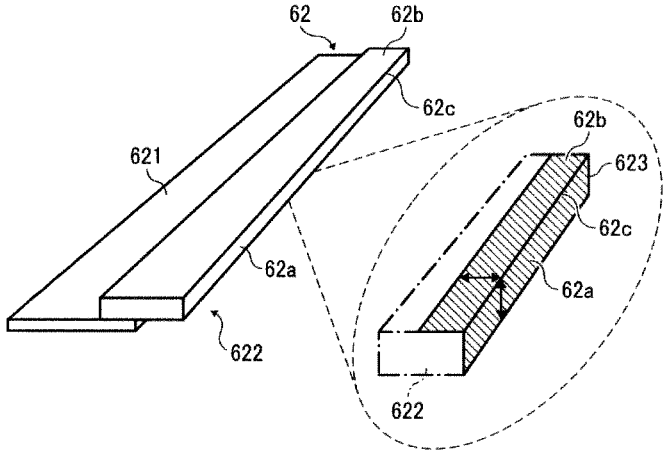
FIG. 5 is a schematic perspective view illustrating an example of the cleaning blade of this disclosure.

FIG. 5 is a perspective view illustrating an example of the cleaning blade of this application, and FIGS. 1A and 1B are enlarged cross-sectional views illustrating the cleaning blade. FIG. 1A illustrates the cleaning blade 62 contacted with a surface of the photoreceptor 3, and FIG. 1B is an enlarged cross-sectional view illustrating the tip of the cleaning blade 62.

Referring to FIGS. 5, 1A and 1B, the cleaning blade 62 includes a strip-shaped holder 621 which is made of a rigid material such as metals and hard plastics, and a strip-shaped elastic blade 622. The elastic blade 622 has an edge portion 62*c*, which is subjected to an impregnation treatment as mentioned below in detail. In addition, a surface layer 623 is formed on each of surfaces of a tip 62*a* and an upper portion of a lower surface 62*b* of the blade 62. As illustrated in FIG. 5, the surface layer 623 extends in the longitudinal direction of the blade 62.

The elastic blade 622 is fixed to an upper end portion of the holder 621, for example, by an adhesive. The other end portion (i.e., the lower end portion) of the holder 621 is supported (cantilevered) by a case of the cleaner 6.

In order that the elastic blade 622 can be satisfactorily contacted with the surface of the photoreceptor 3 even if the photoreceptor 3 is eccentric or the surface thereof is waved, the elastic blade 622 preferably has a high resilience coefficient. Typical synthetic rubbers such as an acrylic rubber, a nitrile rubber, an isoprene rubber, a urethane rubber, an ethylene propylene rubber, a chlorosulfonated polyethylene rubber, an epichlorohydrine rubber, a chloroprene rubber, a silicone rubber, a styrene-butadiene rubber, a butadiene rubber and a fluoro-rubber are used. Rubbers having a urethane group such as urethane rubbers are preferably used therefor.

The impregnation treatment for the edge 62*c* of the elastic blade 622 is typically performed by impregnating the edge with an acrylic and/or a methacrylic monomer using a coating method such as brush coating, spray coating and dip coating. The acrylic and/or methacrylic monomer are crosslinked when applied with an energy such as a heat, light and an electron beam.

Specific examples of the acrylic and/or methacrylic monomer for use in the present invention include trimethylolpropane triacrylate (TMPTA), trimethylolpropane trimethacrylate, trimethylolpropanealkylene-modified triacrylate, trimethylolpropaneethyleneoxy-modified (hereafter EO-modified) triacrylate, trimethylolpropanepropyleneoxy-modified (hereafter PO-modified) triacrylate, trimethylolpropanecaprolactone-modified triacrylate, trimethylolpropanealkylene-modified trimethacrylate, pentaerythritol triacrylate, pentaerythritol tetracrylate (PETTA), glycerol triacrylate, glycerol epichlorohydrin-modified (hereafter ECH-modified) triacrylate, glycerol EO-modified triacrylate, glycerol PO-modified triacrylate, tris(acryloxyethyl) isocyanurate, dipentaerythritol hexaacrylate (DPHA), dipentaerythritolcaprolactone-modified hexaacrylate, dipentaerythritolhydroxy pentaacrylate, alkylated dipentaerythritol pentacrylate, alkylated dipentaerythritol tetraacrylate, alkylated dipentaerythritol triacrylate, dimethylolpropane tetraacrylate (DTMPTA), pentaerythritolethoxy tetraacrylate, phosphoric acid EO-modified triacrylate, and 2,2,5,5-tetrahydroxymethylcyclopentanone tetracrylate. These can be used alone or in combination.

By performing this impregnation treatment on the elastic blade 622, occurrence of the deformation problem in that the edge 62*c* of the elastic blade 622 contacted with the photoreceptor 3 is deformed in the moving direction of the photoreceptor 3 can be prevented. In addition, even when the surface portion of the blade is abraded to an extent such that an internal portion of the blade is exposed, occurrence of the deformation problem can be prevented because the ultraviolet crosslinkable resin penetrates into the internal portion of the elastic blade 622.

Further, a fluoro-acrylic monomer/oligomer can be added. When even a small amount of OPTOOL DAC-HP from Daikin Industries, Ltd. is added, the resin layer has a lower resistivity coefficient and a frictional force with the photoreceptor is reduced to prevent abrasions of both of the elastic blade and the photoreceptor.

After the elastic blade 622 is impregnated with an acrylic and/or a methacrylic crosslinkable resin liquid, followed by natural drying for a predetermined period, the surface layer 623 is formed on the surface of the resin-impregnated portion of the blade using a method such as spray coating, dip coating, and screen printing to cover the edge 62*c* and the surface of a tip portion of the elastic blade 622. Thus, the elastic blade 622 is impregnated with an acrylic and/or a methacrylic crosslinkable resin liquid to form a mixed layer including the substrate and the acrylic and/or methacrylic resin at the surface thereof, and an acrylic and/or a methacrylic resin layer is formed then.

A heat or a light energy may be applied after the elastic blade is impregnated with the acrylic and/or methacrylic crosslinkable resin liquid for a predetermined time or after the acrylic and/or methacrylic resin layer is formed to crosslink the resin.

The thickness of the mixed layer including the substrate and the acrylic and/or methacrylic resin can be controlled by the acrylic and/or methacrylic monomer, solvent, solid contents concentration, impregnation time, temperature, etc.

The mixed layer including the substrate and the acrylic and/or methacrylic resin 1© preferably has a thickness of from 5 to 100 μm, and more preferably from 10 to 30 μm. When too thin, the cleaning blade does not have followability on the surface of a photoreceptor. When too thick, the cleaning blade has larger hardness to increase the load to a photoreceptor, resulting in increase of abrasion thereof and generation of fluttering sounds. Further, the cleaning blade is likely to have a microscopic crack.

The thickness of the mixed layer including the substrate and the acrylic and/or methacrylic resin can be measured by a method disclosed in Japanese published unexamined application No. JP-2011-138110-A using microscopic IR.

The acrylic and/or methacrylic resin layer can be formed while the blade is dipped in an acrylic and/or a methacrylic crosslinkable resin liquid for a predetermined time, but the layer occasionally has a thin thickness. Therefore, after dipped in the acrylic and/or methacrylic crosslinkable resin liquid for a predetermined time to form the mixed layer including the substrate and the acrylic and/or methacrylic resin, the acrylic and/or methacrylic crosslinkable resin liquid is preferably coated on the mixed layer to form the acrylic and/or methacrylic resin layer thereon.

The acrylic and/or methacrylic resin layer is formed by coating the same acrylic and/or methacrylic monomers as those of the impregnating materials and applying an energy such as a heat, light and an electron beam.

The acrylic and/or methacrylic resin layer preferably has a thickness of from 0.5 to 1.0 μm. When too thin, the cleaning blade does not have followability on the surface of a photoreceptor. When too thick, the cleaning blade edge has everted-tip and crack problems when used for long periods.

The thickness of the acrylic and/or methacrylic resin layer can be measured by cutting the cross-section to take a picture thereof with a scanning electron microscope or a transmission electron microscope.

Next, the photoreceptor used in the present invention is explained.

The photoreceptor includes at least an electroconductive substrate, and a photosensitive layer f and a crosslinked surface layer formed of an acrylic and/or a methacrylic crosslinkable resin thereon.

First, layer structures of the photoreceptor used in the present invention is explained.

Figure 9A:
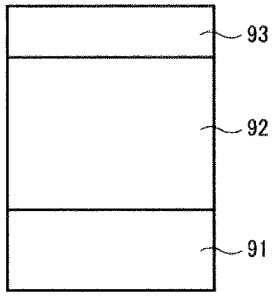
FIGS. 9A to 9C are schematic views illustrating examples of photosensitive layer of photoreceptors use in the image forming apparatus of the present invention.
Figure 9B:
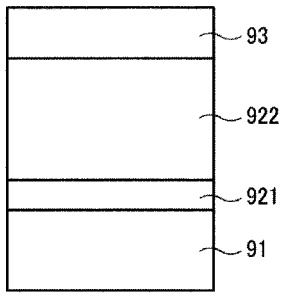
Figure 9C:
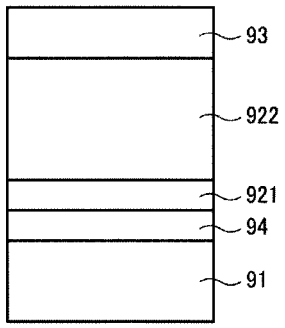

FIG. 9A is an examples of the layer structures thereof including an electroconductive substrate 91, and a photosensitive layer 92 and a crosslinked surface layer 93 formed of an acrylic and/or a methacrylic crosslinkable resin thereon. FIG. 9B is an examples of the layer structures thereof including an electroconductive substrate 91, and a photosensitive layer 92 including a charge generation layer 921 and a charge transport layer 922 and a crosslinked surface layer 93 formed of art acrylic and/or a methacrylic crosslinkable resin thereon. FIG. 9C is an examples of the layer structures thereof including an electroconductive substrate 91, and an undercoat layer 94, a photosensitive layer 92 including a charge generation layer 921 and a charge transport layer 922 and a crosslinked surface layer 93 formed of an acrylic and/or a methacrylic crosslinkable resin thereon.

The photoreceptor used in the present invention includes at least an electroconductive substrate 91, and a photosensitive layer 92 and a surface layer 93 thereon. The photoreceptor may include other layers.

Suitable materials for use as the electroconductive substrate 91 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can be also used as the substrate. Further, endless belts of a metal such as nickel and stainless steel, which have been disclosed in Japanese published unexamined application No. JP-S52-36016-A can be also used as the electroconductive substrate 91.

Furthermore, substrates, in which a coating liquid including a binder resin and an electroconductive powder is coated on the supporters mentioned above, can be used as the substrate 91. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like.

Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can be also used as the substrate 91.

Next, the photosensitive layer of the present invention is explained.

In the present invention, the photosensitive layer may be single-layered or a multi-layered. At first, the multi-layered photosensitive layer including the charge generation layer (CGL) 921 and the charge transport layer (CTL) 922 is explained for explanation convenience.

The CGL 921 is a layer including a charge generation material (CGM) as the main component. Known CGMs can be used in the CGL 921. Specific examples of the CGM include, but are not limited to, monoazo pigments, disazo pigments, trisazo pigments, perylene pigments, perynone pigments, quinacridone pigments, quinone type condensed polycyclic compounds, squaric acid type dyes, other phthalocyanine pigments, naphthalocyanine pigments, azulenium salt dyes, etc.

These CGMs can be used alone or in combination.

In the present invention, particularly an azo pigment and/or a phthalocyanine pigment are effectively used.

Particularly, an azo pigment having the following formula (1) and titanyl phthalocyanine pigment having a CuKα 1.542 Å X-ray diffraction spectrum including a maximum diffraction peak at least at a Bragg (2θ) angle of 27.2° are effectively used.

(1)

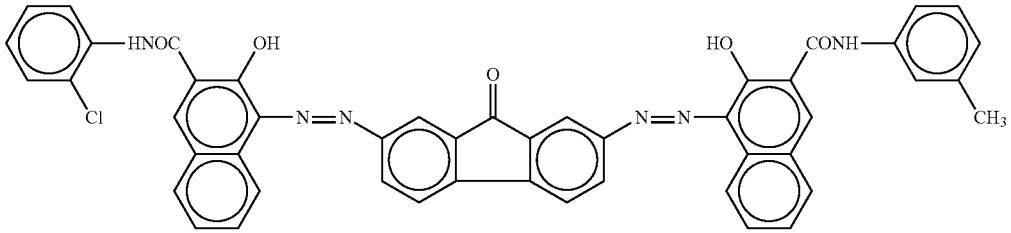

The CGL 921 is formed by coating a coating liquid in which the CGM is dispersed in a solvent with a binder resin when necessary on the electroconductive substrate 91 and drying the liquid.

Specific examples of the binder resin used in the CGL 921 when necessary include, but are not limited to, polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, u polyphenylene oxide, polyamides, polyvinyl pyridine, cellulose resins, casein, polyvinyl alcohol, polyvinyl pyrrolidone, etc.

A weight ratio of the binder resin to the CGM is typically from 0 to 500, and preferably from 10 to 300 parts by weight per 100 parts by weight of the CGM.

Specific examples of the solvents include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc. In particular, ketone type solvents, ester type solvents and ether type solvents are preferably used.

Specific examples of methods of coating a coating liquid include, but are not limited to, dip coating methods, spray coating methods, bead coating methods, nozzle coating methods, spinner coating methods, ring coating methods, etc.

The CGL 921 typically has a thickness of from 0.01 to 5 μm, and preferably from 0.1 to 2 μm.

The CTL 922 is formed by coating a coating liquid in which a charge transport material (CTM) is dissolved or dispersed with a binder resin in a solvent on the CGL 921 formed on the electroconductive substrate 91.

The CTL 922 may include a plasticizer, a leveling agent and an antioxidant when necessary.

The CTM includes a positive hole transport material and an electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, benzoquinone derivatives, etc.

Specific examples of the positive hole transport materials include poly(N-carbazole) and its derivatives, poly(γ-carbazolylethylglutamate) and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc. These can be used alone or in combination.

Specific examples of the binder resin include, but are not limited to, thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, acrylic resins, silicone resins, epoxy resins, melamine resins, urethane resins, phenolic resins and alkyd resins.

A weight ratio of the CTM to the binder resin is from 20 to 300, and preferably from 40 to 150 parts by weight per 100 parts by weight of the binder resin.

The CTL 922 preferably has a thickness of 25 μm or less because of image resolution and response.

The CTL 922 preferably has a minimum thickness not less than 5 μm, although depending on a system used (particularly charge potential).

Specific examples of the solvent include, but are not limited to, tetrahydrofuran, dioxane, toluene, dichloromethane, monochlorobenzene, dichloroethane, cyclohexanone, methyl ethyl ketone, acetone, etc.

The CTL 922 may further include a plasticizer and a leveling agent.

Specific examples of the plasticizer include, but are not limited to, dibutylphthalate and dioctylphthalate, etc. The CTL 922 preferably includes the plasticizer in an amount of from 0 to 30% by weight based on total weight of the binder resin.

Specific examples of the leveling agents include, but are not limited to, silicone oil such as dimethylsilicone oil and methylphenylsilicone oil; and polymers and oligomers having a perfluoroalkyl group in the side chain. The CTL 922 preferably includes the leveling agent in an amount of from 0 to 1% by weight based on total weight of the binder resin.

Next, a single-layered photosensitive layer 92 is explained. A photoreceptor in which the above-mentioned CGM is dispersed in the binder resin can be used. The photosensitive layer 92 can be formed by coating a coating liquid in which a CGM, a CTM and a binder resin are dissolved or dispersed in a proper solvent, and then drying the coated liquid.

The photosensitive layer 92 includes an inorganic particulate material when being the surface layer 93.

The photosensitive layer 92 may be a functionally-separated layer including the CTM.

In addition, the photosensitive layer 92 may optionally include additives such as plasticizers, leveling agents and antioxidants.

Suitable binder resins include the resins mentioned above in the CTL 922. The resins mentioned above in the CGL can be added as a binder resin.

The photosensitive layer 92 preferably includes a CGM in an amount of from 5 to 40 parts by weight, and a CTM in an amount of from 0 to 190, and more preferably from 50 to 150 parts by weight based on total weight of the binder resin.

The single-layered photosensitive layer 92 can be formed by coating a coating liquid in which a CGM, a binder resin and a CTM are dissolved or dispersed in a solvent such as tetrahydrofuran, dioxane, dichloroethane, cyclohexane, etc. by a coating method such as a dip coating method, spray coating method, a bead coating method and a ring coating method. The thickness of the photosensitive layer is preferably from 5 to 25 μm.

In the photoreceptor of the present invention, an undercoat layer 94 may be formed between the substrate 91 and the photosensitive layer 92.

The undercoat layer 94 includes a resin as a main component. Since the photosensitive layer 94 is typically formed on the undercoat layer by coating a liquid including an organic solvent, the resin in the undercoat layer preferably has good resistance against general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network structure such as polyurethane resins, melamine resins, alkyd-melamine resins, epoxy resins and the like.

The undercoat layer 94 may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer 94 can be formed by coating a coating liquid using a proper solvent and a proper coating method similarly to those for use in formation of the photosensitive layer 92 mentioned above.

The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer.

Other than these, known materials can be used.

The thickness of the undercoat layer is preferably 0 to 5 μm.

In the photoreceptor of the present invention, a crosslinked surface layer 93 formed of an acrylic and/or a methacrylic may be formed on the photosensitive layer 92.

The crosslinked surface layer 93 is formed by coating a coating liquid including at least an acrylic and/or a methacrylic radical polymerizable monomer having no charge transportability and an acrylic and/or a methacrylic radical polymerizable compound having charge transportability and curing the liquid.

Specific examples of the radical polymerizable monomer and the radical polymerizable compound includes materials disclosed in Japanese published unexamined application No. JP-2001-164455-A.

When the radical polymerizable monomer is a liquid, other components are dissolved therein to prepare the coating liquid. The coating liquid may be diluted in a solvent when necessary. Specific examples of the solvent include alcohols such as methanol, ethanol, propanol and butanol; ketones such as acetone, methyl ethyl ketone, methyl isobutyl ketone and cyclohexanone; esters such as ethylacetate and butylacetate; ethers such as tetrahydrofuran, dioxane and propylether; halogens such as dichloromethane, dichloroethane, trichloroethane and chlorobenzene; aromatics such as benzene, toluene and xylene; and cellosolves such as methylcellosolve, ethylcellosolve and cellosolve acetate. These solvents can be used alone or in combination. The dilution ratio depends on solubility of the components, coating methods and the thickness. Specific examples of methods of coating the coating liquid include, but are not limited to, dip coating methods, spray coating methods, bead coating methods, ring coating methods, etc.

In the present invention, the coating liquid cured after coated with an external optical energy to form a crosslinked surface layer is preferably used. High pressure mercury lamps and metal halide lamps having an emission wavelength of UV light can be used to apply the optical energy. Light sources emitting visible light can also be used to comply with absorption light wavelength of the radical polymerizable content or a photopolymerization initiator. A crosslinking reaction using radical polymerization is largely influences by temperature, and the surface temperature of the layer when irradiated with US is preferably maintained at from 20 to 170° C. Any methods can be used if this surface temperature is maintained, but a heat medium is preferably used.

In a case where an acrylate monomer having three acryloyloxy group and a triarylamine compound having one acryloyloxy group are used for the crosslinked surface layer coating liquid, the weight ratio (A/T) of the acrylate monomer (A) to the triarylamine compound (T) is preferably 7/3 to 3/7. The additive amount of a polymerization initiator is preferably from 3 to 20% by weight based on the total weight of the acrylate monomer (A) and the triarylamine compound (T). In addition, a proper solvent is preferably added to the coating liquid. Provided that the CTL, on which the crosslinked surface layer coating liquid is coated, is formed of a triarylamine compound (serving as a CTM) and a polycarbonate resin (serving as a binder resin), and the crosslinked surface layer coating liquid is coated by a spray coating method, the solvent of the crosslinked surface layer coating liquid is preferably selected from tetrahydrofuran, 2-butanone, and ethyl acetate. The additive amount of the solvent is preferably from 300 to 1000 parts by weight per 100 parts by weight of the acrylate monomer (A).

The crosslinked surface layer is preferably insoluble in an organic solvent. When not fully crosslinked, the surface layer is soluble in an organic solvent, and has low crosslink density and mechanical durability.

Next, on a substrate such as an aluminum cylinder, an undercoat layer, a CGL and a CTL are layered in this order to prepare a photoreceptor, and the coating liquid is sprayed thereon. Then, the photoreceptor is dried naturally and irradiated with UV light to cure the coated layer.

A metal halide lamp, or the like, is preferably used to irradiate the UV light at an illuminance of from 50 to 1,000 $mW/cm^2$. For example, when the UV light having an illuminance of 700 $mW/cm^2$ is irradiated onto a photoreceptor (drum), the drum is rotated to be uniformly irradiated for about 2 min. Then, the drum is controlled not to have too high a temperature using a heat medium.

After cured, the drum is heated at from 100 to 150° C. for 10 to 30 min for reducing a residual solvent to prepare a photoreceptor.

It is preferable that the atmosphere has quite low oxygen density when the UV light is irradiated to promote curing. Then, it is more preferable that even the atmosphere of a part of the drum unirradiated with UV light has low oxygen density. This largely prevents the oxygen from impairing radical polymerization, and the resultant surface layer has higher crosslink density.

In addition, it is effective that the surface layer is formed by spray coating and naturally drying in an atmosphere tilled with nitrogen with low oxygen density.

The crosslinked surface layer preferably has a thickness of from 1 to 30 μm, more preferably from 2 to 20 μm, and even more preferably from 3 to 10 μm.

When less than 1 μm, the photoreceptor occasionally deteriorates in durability because the thickness is too thin to absorb a carrier when adhering thereto. When larger than 30 μm, a residual potential occasionally increases. Therefore, the crosslinked surface layer preferably has a thickness such that the resultant photoreceptor has less abrasion, damages and residual potential.

The crosslinked surface layer may include a particulate filler, which largely improves abrasion resistance and prolongs life of the resultant photoreceptor. Further, the particulate filler forms microscopic convexities and concavities on the surface, and a lubricant formed of a fatty acid metal salt such as zinc stearate and a calcium stearate can more easily be coated thereon. Therefore, the resultant photoreceptor improves in cleanability and transferability. The following particulate fillers can be used. Specific examples of organic fillers include powders of fluorocarbon resins such as polytetrafluoroethylene, silicone resin powders and a-carbon powders. Specific examples of inorganic fillers include powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin and potassium titanate. Among these fillers, inorganic materials are advantageously used in terms of hardness of the filler. Particularly, metal oxides such as silicon oxide, aluminum oxide and titanium oxide are preferably used. Particulate colloidal silica and colloidal alumina can be used as well.

The filler preferably has an average primary particle diameter of from 0.01 to 0.5 μm in terms of a light transmittance and an abrasion resistance of the surface layer. When less than 0.01 μm, dispersibility thereof deteriorates and the surface does not have a sufficient abrasion resistance. When greater than 0.5 μm, the filler quickly settles down in a dispersion liquid and filming of a toner over the surface layer occurs.

The higher the concentration of the filler material in the surface layer, the higher the abrasion resistance. However, when the concentration is too high, a residual potential increases and a writing light transmittance of the surface layer deteriorates. Therefore, the filler material preferably has a concentration not greater than 50% by weight, and more preferably not greater than 30% by weight based on total weight of solid contents in the surface layer.

Further, a surface of the filler is preferably treated with a surface treatment agent to improve dispersibility thereof. The dispersibility deterioration of the filler causes not only an increase of a residual potential but also transparency deterioration of the surface layer and a defect thereof, and further deterioration of the abrasion resistance thereof. Therefore, it is probable that the dispersibility deterioration of the filler will be a serious problem impairing a high durability of the resultant photoreceptor or high-quality images produced thereby. Specific examples of the surface treatment agent include any conventional surface treatment agents, but they preferably can maintain an insulation of the filler. Specific examples thereof include titanate coupling agents, aluminium coupling agents, zircoaluminate coupling agents, higher fatty acids and mixtures of each agent with a silane coupling agents; and $AL_2O_3$, $TiO_2$, $ZRO_2$, silicone, aluminium stearate and their mixtures. These are preferably used to improve dispersibility of the filler and prevent blurred images. The silane coupling agents occasionally causes blurred images, but a mixture of the surface treatment agent and the silane coupling agent occasionally can prevent the influence. Although an amount of the surface treatment agent depends on the primary particle diameter of a filler, the amount thereof is preferably from 3 to 30% by weight, and more preferably from 5 to 20% by weight base on total weight of the filler. When less than 3% by weight, the filler is not well dispersed. When greater than 30% by weight, a residual potential significantly increases. These filler materials can be used alone or in combination. The filler dispersed in the crosslinked surface layer in which a three-dimensional network structure is formed largely improves the abrasion resistance of the resultant photoreceptor.

In the photoreceptor of the present invention, antioxidants, plasticizers, lubricants, ultraviolet absorbents and leveling agents can be included in each layer such as the CGL, CTL, undercoat layer, protection layer and intermediate layer for environmental improvement, above all for the purpose of preventing decrease of photosensitivity and increase of residual potential. Such compounds are shown as follows.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis ethyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-Containing Compounds

Dilauryl-3,3'-thiodipropionate, distearyl-3,3'-thiodipropionate, ditetradecyl-3,3'-thiodipropionate, and the like.

(e) Organic Phosphorus-Containing Compounds

Triphenylphosphine, tri(nonylphenyl)phosphine, tri(di-nonylphenyl)phosphine, tricresylphosphine, tri(2,4-dibutylphenoxy)phosphine and the like.

Suitable plasticizers for use in the layers of the photoreceptor include the following compounds, but are not limited thereto.

(a) Phosphoric Acid Esters Plasticizers

Triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters Plasticizers

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters Plasticizers

Trioctyl trimellitate, tri-n-octyl trimellitate, octyl oxybenzoate, and the like.

(d) Dibasic Fatty Acid Esters Plasticizers

Dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives

Butyl oleate, glycerin monooleate, methyl acetylricinolate, pentaerythritol esters, dipentaerythritol hexaesters, triacetin, tributyrin, and the like.

(f) Oxyacid Esters Plasticizers

Methyl acetylricinolate, butyl acetylricinolate, butylphthalylbutyl glycollate, tributyl acetylcitrate, and the like.

(g) Epoxy Plasticizers

Epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters Plasticizers

Diethylene glycol dibenzoate, triethylene glycol di-2-ethylbutyrate, and the like.

(i) Chlorine-Containing Plasticizers

Chlorinated paraffin, chlorinated diphenyl, methyl esters of chlorinated fatty acids, methyl esters of methoxychlorinated fatty acids, and the like.

(j) Polyester Plasticizers

Polypropylene adipate, polypropylene sebacate, acetylated polyesters, and the like.

(k) Sulfonic Acid Derivatives

P-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives

Triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds

Terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbon Compounds

Liquid paraffins, paraffin waxes, micro waxes, low molecular weight polyethylenes, and the like.

(b) Fatty Acid Compounds

Laurie acid, myristic acid, palmitic acid, stearic acid, arachidic acid, behenic acid, and the like.

(c) Fatty Acid Amide Compounds

Stearic acid amide, palmitic acid amide, oleic acid amide, methylenebisstearamide, ethylenebisstearamide, and the like.

(d) Ester Compounds

Lower alcohol esters of fatty acids, polyhydric alcohol esters of fatty acids, polyglycol esters of fatty acids, and the like.

(e) Alcohol Compounds

Cetyl alcohol, stearyl alcohol, ethylene glycol, polyethylene glycol, polyglycerol, and the like.

(f) Metallic Soaps

Lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds

Silicone compounds, fluorine compounds, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds

Phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole and (2'-hydroxy-3'-t-butyl-5'-methylphenyl)-5-chlorobenzotriazole.

(d) Cyano Acrylate Compounds

Ethyl-2-cyano-3,3-diphenyl acrylate, methyl-2-carbomethoxy-3-(paramethoxy) acrylate, and the like.

(e) Quenchers (Metal Complexes)

Nickel(2,2'-thiobis(4-t-octyl)phenolate)-n-butylamine, nickeldibutyldithiocarbamate, cohaltdicyclohexyldithiophosphate, and the like.

(f) HALS (Hindered Amines)

Bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetramethylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

The crosslinked surface layer 93 preferably has a Martens hardness not less than 160N/mm$^2$ and an elastic power ratio (We/Wt value) not less than 38.0% for the purpose of maintaining the followability of the cleaning blade on the photoreceptor for long periods. The Martens hardness and the elastic power ratio are measured under the following conditions.

Measurer: Fischerscope H-100

Test method: Load an unload repeat (once) test

Indenter: Micro Vickers indenter

Max. load: 9.8 mN

Load (unload) time: 30 sec

Hold time: 5 sec

When the Martens hardness is less than 160N/mm$^2$, a toner is fixed on the surface of the photoreceptor. When the elastic power ratio (We/Wt value) is less than 38.0%, the three-dimensional network structure in the surface layer does not have sufficient durability. When an image area ratio in an axial direction of the photoreceptor, an abrasion speed thereof changes, resulting in uneven abrasion. The hardness and the elastic power ratio of the photoreceptor are controlled by a mixed ratio of the radical polymerizable monomer to the radical polymerizable compound, an external optical energy amount, and the curing temperature.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Blade Preparation Example

[Base Material Elastic Blade]

I. Constituent Material of Elastic Blade 622

The following materials were used for the elastic blade 622.

| Material | Hardness (°) at 25° C. | Resilience coefficient (%) at 25° C. | Manufacturer |
|---|---|---|---|
| Urethane rubber 1 | 66 | 46 | Bando Chemical Industries, Ltd. |
| Urethane rubber 2 | 70 | 50 | Toyo Tire & Rubber Co., Ltd. |
| Urethane rubber 3 | 72 | 31 | Toyo Tire & Rubber Co., Ltd. |
| Urethane rubber 4 | 75 | 21 | Toyo Tire & Rubber Co., Ltd. |
| Urethane rubber 5 | 77 | 19 | Synztec Co., Ltd. |

The hardness of the urethane rubbers 1-5 was measured by a method defined in JIS K6253 using a durometer manufactured by Shimadzu Corp. When measuring the hardness, sheets (with a thickness of about 2 mm) of each of the urethane rubbers were overlaid so that the rubber has a thickness of not less than 12 mm.

The resilience coefficient of the urethane rubbers 1-5 was measured by a method defined in JIS K6255 using a resilience tester No. 221 manufactured by Toyo Seiki Seisaku-Sho Ltd. When measuring the resilience coefficient, sheets (with a thickness of about 2 mm) of each of the urethane rubbers were overlaid so that the rubber has a thickness of not less than 4 mm.

A strip-shaped elastic blade having a thickness of 1.8 mm was formed from the urethane rubber. The elastic blade was subjected to the following processes to form a substrate and an acrylic and/or a methacrylic resin mixed layer and an acrylic and/or a methacrylic resin surface layer.

[Blade Mixed Layer Forming Material]

The elastic blade was dipped in the following mixed layer forming material liquid for a predetermined time to form a substrate and an acrylic and/or a methacrylic resin mixed layer.

<Mixed Layer Material 1>

| | |
|---|---|
| Monomer: PETIA (from DAICEL-CYTEC Co., Ltd.) | 10 parts |
| Polymerization initiator (IRGACURE 184 from Ciba Specialty Chemicals) | 1 part |
| Solvent: Tetrahydrofuran | 149 parts |

<Mixed Layer Material 2>

| | |
|---|---|
| Monomer 1: PETIA (from DAICEL-CYTEC Co., Ltd.) | 9 parts |
| Monomer 2: HDDA (from DAICEL-CYTEC Co., Ltd.) | 1 part |
| Polymerization initiator (IRGACURE 184 from Ciba Specialty Chemicals) | 1 part |
| Solvent: Tetrahydrofuran | 149 parts |

<Mixed Layer Material 3>

| | |
|---|---|
| Monomer: DPHA (from DAICEL-CYTEC Co., Ltd.) | 10 parts |
| Polymerization initiator (IRGACURE 184 from Ciba Specialty Chemicals) | 1 part |
| Solvent: Tetrahydrofuran | 149 parts |

<Mixed Layer Material 4>

| | |
|---|---|
| Monomer: DPCA-120 (from Nippon Kayaku Co., Ltd.) | 10 parts |
| Polymerization initiator (IRGACURE 184 from Ciba Specialty Chemicals) | 1 part |
| Solvent: Tetrahydrofuran | 149 parts |

<Mixed Layer Material 5>

| | |
|---|---|
| Monomer 1: SUMIJULE HT<HDI adduct> (from Sumika Bayer Urethane Co., Ltd.) | 8 parts |
| Monomer 2: Polyol having the following formula (from KANTO CHEMICAL CO., INC.) | 2 parts |

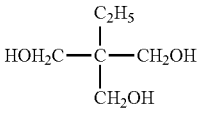

| | |
|---|---|
| Solvent: Tetrahydrofuran | 110 parts |

<Mixed Layer Material 6>

| | |
|---|---|
| Monomer: PETIA from DAICEL-CYTEC Co., Ltd. | 10 parts |
| Fluorine monomer: OPTOOL DAC-HP from Daikin Industries, Ltd. | 0.3 parts |
| Polymerization initiator IRGACURE 184 from Ciba Specialty Chemicals | 1 part |
| Solvent: Tetrahydrofuran | 149 parts |

<Mixed Layer Material 7>

| | |
|---|---|
| DPHA from DAICEL-CYTEC Co., Ltd. | 10 parts |
| Fluorine oligomer: Megafac RS-75 from DIC Corp. | 0.3 parts |
| Polymerization initiator IRGACURE 184 from Ciba Specialty Chemicals | 1 part |
| Solvent: Tetrahydrofuran | 149 parts |

[Blade Surface Layer Forming Material]

The following surface layer forming material liquid was sprayed on the substrate and acrylic and/or a methacrylic resin mixed layer to form an acrylic and/or a methacrylic resin surface layer. The surface layer forming materials 1 to 4 were irradiated with UV light to be optically crosslinked. The surface layer forming material 5 was heated to be thermally crosslinked. The surface layer thickness was controlled by the spray coating conditions such as a spray amount and a coating speed.

<Surface Layer Material 1>

| | |
|---|---|
| Monomer: PETIA from DAICEL-CYTEC Co., Ltd. | 10 parts |
| Polymerization initiator IRGACURE 184 from Ciba Specialty Chemicals | 1 part |
| Solvent: 2-butanone | 89 parts |

<Surface Layer Material 2>

| | |
|---|---|
| Monomer 1: PETIA from DAICEL-CYTEC Co., Ltd. | 9 parts |
| Monomer 2: HDDA from DAICEL-CYTEC Co., Ltd. | 1 part |
| Polymerization initiator IRGACURE 184 from Ciba Specialty Chemicals | 1 part |
| Solvent: 2-butanone | 89 parts |

<Surface Layer Material 3>

| | |
|---|---|
| Monomer: DPHA from DAICEL-CYTEC Co., Ltd. | 10 parts |
| Polymerization initiator IRGACURE 184 from Ciba Specialty Chemicals | 1 part |
| Solvent: 2-butanone | 89 parts |

<Surface Layer Material 4>

| | |
|---|---|
| Monomer: DPCA-120 (from Nippon Kayaku Co., Ltd.) | 10 parts |
| Polymerization initiator (IRGACURE 184 from Ciba Specialty Chemicals) | 1 part |
| Solvent: 2-butanone | 89 parts |

<Surface Layer Material 5>

| | |
|---|---|
| Monomer 1: SUMIJULE HT<HDI adduct> (from Sumika Bayer Urethane Co., Ltd.) | 8 parts |
| Monomer 2: Polyol having the following formula (from KANTO CHEMICAL CO., INC.) | 2 parts |

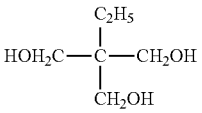

| | |
|---|---|
| Solvent: 2-butanone | 70 parts |

<Surface Layer Material 6>

| | |
|---|---|
| Monomer: PETIA from DAICEL-CYTEC Co., Ltd. | 10 parts |
| Fluorine monomer: OPTOOL DAC-HP from Daikin Industries, Ltd. | 0.3 parts |
| Polymerization initiator IRGACURE 184 from Ciba Specialty Chemicals | 1 part |
| Solvent: 2-butanone | 89 parts |

<Mixed Layer Material 7>

| | |
|---|---|
| DPHA from DAICEL-CYTEC Co., Ltd. | 10 parts |
| Fluorine oligomer: Megafac RS-75 from DIC Corp. | 0.3 parts |
| Polymerization initiator IRGACURE 184 from Ciba Specialty Chemicals | 1 part |
| Solvent: 2-butanone | 89 parts |

<Optical Crosslink Conditions>

| |
|---|
| UV irradiation: Metal Halide Lamp (from USHIO INC.)<br>Irradiation intensity: 500 mW/cm$^2$ (365 nm)<br>UV lamp-blade distance: 100 mm<br>Irradiation time: 60 sec |

<Thermal Crosslink Conditions>

| |
|---|
| Heating temperature: 150° C.<br>Heating time: 20 min |

The thus prepared cleaning blades are shown in Table 1

TABLE 1

| | | Mixed Layer | | | Surface Layer | |
|---|---|---|---|---|---|---|
| Blade | Base Blade | Material | Time s | Thickness μm | Material | Thickness μm |
| Blade 1 | 2 | 1 | 5 | 5 | 1 | 0.8 |
| Blade 2 | 2 | 1 | 8 | 9 | 1 | 0.8 |
| Blade 3 | 2 | 1 | 11 | 11 | 1 | 0.8 |
| Blade 4 | 2 | 1 | 20 | 15 | 1 | 0.8 |
| Blade 5 | 2 | 1 | 30 | 20 | 1 | 0.8 |
| Blade 6 | 2 | 1 | 55 | 29 | 1 | 0.8 |
| Blade 7 | 2 | 1 | 75 | 32 | 1 | 0.8 |
| Blade 8 | 2 | 1 | 120 | 41 | 1 | 0.8 |
| Blade 9 | 2 | 1 | 1800 | 92 | 1 | 0.8 |
| Blade 10 | 2 | 1 | 3600 | 103 | 1 | 0.8 |
| Blade 11 | 1 | 1 | 30 | 20 | 1 | 0.8 |
| Blade 12 | 3 | 1 | 30 | 20 | 1 | 0.8 |
| Blade 13 | 4 | 1 | 30 | 20 | 1 | 0.8 |
| Blade 14 | 5 | 1 | 30 | 20 | 1 | 0.8 |
| Blade 15 | 3 | 1 | 30 | 20 | 1 | 0.4 |
| Blade 16 | 3 | 1 | 30 | 20 | 1 | 0.6 |
| Blade 17 | 3 | 1 | 30 | 20 | 1 | 0.9 |
| Blade 18 | 3 | 1 | 30 | 20 | 1 | 1.2 |
| Blade 19 | 3 | 2 | 30 | 20 | 2 | 0.8 |
| Blade 20 | 3 | 3 | 30 | 15 | 3 | 0.8 |
| Blade 21 | 3 | 4 | 30 | 15 | 4 | 0.8 |
| Blade 22 | 3 | 3 | 30 | 15 | 1 | 0.8 |
| Blade 23 | 3 | 5 | 30 | 30 | 5 | 0.8 |
| Blade 24 | 2 | 1 | 30 | 20 | 1 | 0.05 |
| Blade 25 | 2 | 1 | 0 | 0.2 | 1 | 0.8 |

TABLE 1-continued

| | | Mixed Layer | | | Surface Layer | |
|---|---|---|---|---|---|---|
| Blade | Base Blade | Material | Time s | Thickness μm | Material | Thickness μm |
| Blade 26 | 3 | 1 | 30 | 20 | 1 | 0.05 |
| Blade 27 | 3 | 1 | 0 | 0.2 | 1 | 0.8 |
| Blade 28 | 2 | — | — | — | — | — |
| Blade 29 | 3 | — | — | — | — | — |

TABLE 1-continued

| | | Mixed Layer | | | Surface Layer | |
|---|---|---|---|---|---|---|
| Blade | Base Blade | Material | Time s | Thickness μm | Material | Thickness μm |
| Blade 30 | 3 | 1 | 30 | 20 | 5 | 0.8 |
| Blade 31 | 3 | 1 | 30 | 20 | 6 | 0.8 |
| Blade 32 | 3 | 5 | 30 | 20 | 5 | 0.8 |
| Blade 33 | 3 | 5 | 30 | 20 | 6 | 0.8 |
| Blade 34 | 3 | 6 | 30 | 20 | 5 | 0.8 |
| Blade 35 | 3 | 6 | 30 | 20 | 6 | 0.8 |

Photoreceptor Preparation Example

Photoreceptor 1

[Substrate]

An aluminum cylinder having an outer diameter of 40 mm was used as a substrate to prepare a photoreceptor.

[Undercoat Layer]

An undercoat layer coating liquid having the following formulation was coated on the substrate by dip coating method to form an undercoat layer having a thickness of 3.5 μm thereon.

Alkyd resin: Beckosol 1307-60-EL from DIC Corporation

Melamine resin: Super Beckamine G-821-60 from DIC Corporation

Titanium oxide: CR-EL from Ishihara Sangyo Kaisha Ltd.

Methyl ethyl ketone

Mixing ratio (weight): alkyd resin/melamine resin/titanium oxide/methyl ethyl ketone=3/2/20/100

[CGL]

A CGL coating liquid having the following formulation was coated on the undercoat layer by dip coating method, and heated to be dry to form a CGL having a thickness of 0.2 μm thereon.

Bisazo pigment having the following formula:

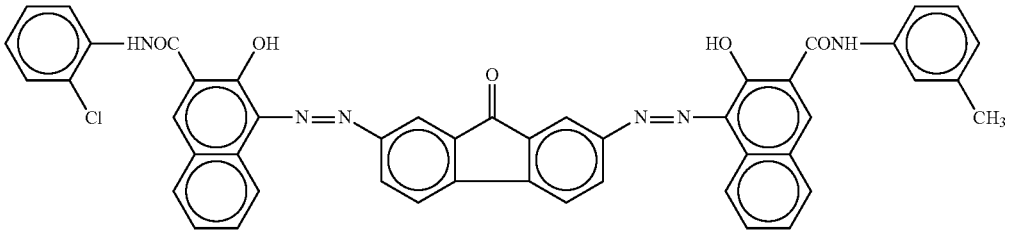

Polyvinyl butyral (XYHL from Union Carbide Corp.)

2-butanonecyclohexanone

Mixing ratio (weight): bisazo pigment/polyvinylbutyral/2-butanonecyclohexanone=5/1/100/200

[CTL]

A CTL coating liquid having the following formulation was coated on the CGL by dip coating method, and heated to be dry to form a CTL having a thickness of 22 μm thereon.

Bisphenol Z-type polycarbonate (CTM) having the following formula (A).

(A)

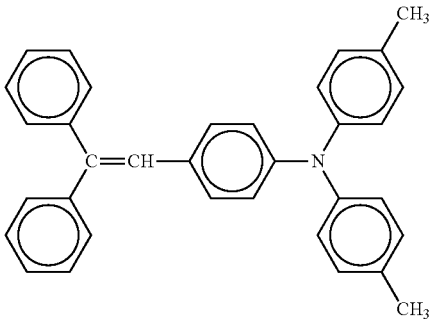

Tetrahydrofuran

Mixing ratio (weight): polycarbonate/CTM/tetrahydrofuran=1/1/10

[Surface Layer]

A crosslinked surface layer coating liquid 1 having the following formulation was sprayed on the CTL, and naturally dried for 5 min. Then, in a UV irradiating booth in which the air is replaced with a nitrogen gas to have an oxygen density not greater than 2%, an UV ray was irradiated by a metal halide lamp having a power of 160 W/cm to the surface for 60 sec at an irradiation distance of 120 mm and an irradiation intensity of 700 mW/cm$^2$. Then, the surface was dried at 130° C. for 20 min to form a crosslinked surface layer 5 μm thick. Thus, a photoreceptor was prepared.

Crosslinked Surface Layer Coating Liquid 1

| | |
|---|---|
| Radical polymerizable monomer having no charge transportability and the following formula (I). | 10 parts |

(I)

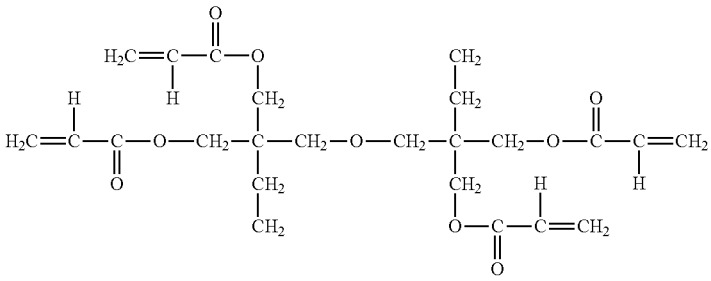

(SR355 from Sartomer Company Inc.)

| | |
|---|---|
| Radical polymerizable compound having charge transportability and the following formula (a). | 10 parts |

(a)

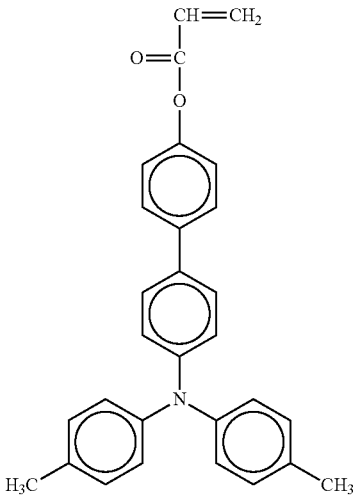

| | |
|---|---|
| Photopolymerization initiator | 0.5 parts |
| 1-hydroxy-cyclohexyl-phenyl-ketone (Irgacure 184, from Ciba Specialty Chemicals) | |
| Inorganic particulate material | 2 parts |
| (Alumina AA-05 from Sumitomo Chemical Co., Ltd.) | |
| Tetrahydrofuran | 100 parts |

Photoreceptor 2

The procedure for preparation of the photoreceptor 1 was repeated to prepare a photoreceptor 2 except for replacing the crosslinked surface layer coating liquid 1 with a crosslinked surface layer coating liquid 2 having the following formulation.

Crosslinked Surface Layer Coating Liquid 2

| | |
|---|---|
| Radical polymerizable monomer having no charge transportability and the following formula (II) | 6 parts |

(II)

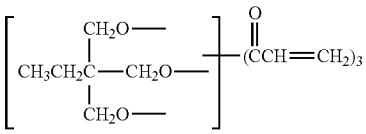

(KAYARAD TMPTA from Nippon Kayaku Co., Ltd.)

| | |
|---|---|
| Radical polymerizable monomer having no charge transportability and the following formula (III) | 6 parts |

(III)

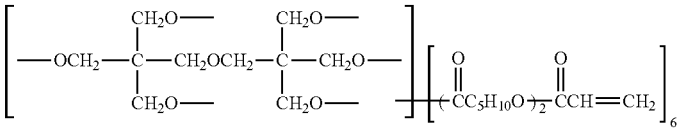

(KAYARAD DPCA-120 from Nippon Kayaku Co., Ltd.)

| | |
|---|---|
| Radical polymerizable compound having charge transportability and the following formula (b). | 10 parts |

(b)

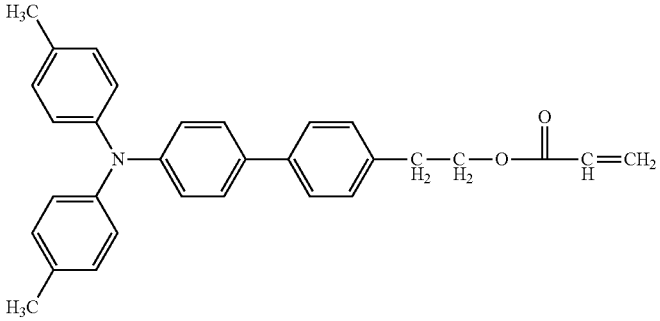

| | |
|---|---|
| Photopolymerization initiator | 0.5 parts |
| 1-hydroxy-cyclohexyl-phenyl-ketone (Irgacure 184, from Ciba Specialty Chemicals) | |
| Inorganic particulate material | 2 parts |
| Silica KMPX100 from Shin-Etsu Chemical Co., Ltd. | |
| Tetrahydrofuran | 100 parts |

Photoreceptor 3

The procedure for preparation of the photoreceptor 1 was repeated to prepare a photoreceptor 3 except for replacing the CTM (A) in the CTL with a CTM having the following formula (B) and the crosslinked surface layer coating liquid 1 with a crosslinked surface layer coating liquid 3 having the following formulation.

(B)

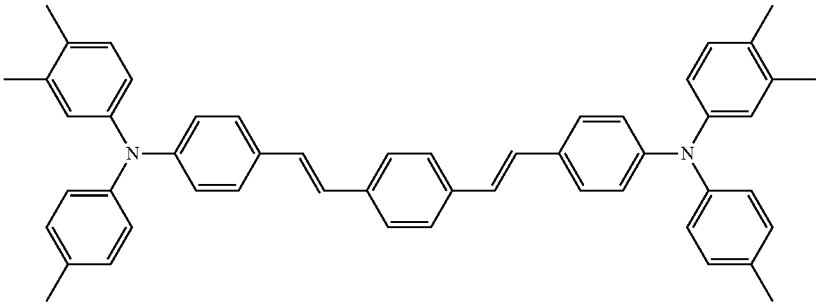

Crosslinked Surface Layer Coating Liquid 3

| | |
|---|---|
| Radical polymerizable monomer having no charge transportability and the following formula (II) | 8 parts |

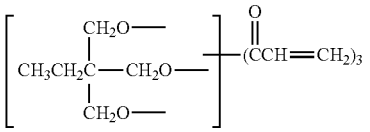

(II)

| | |
|---|---|
| Radical polymerizable compound having charge transportability and the following formula (b). | 10 parts |

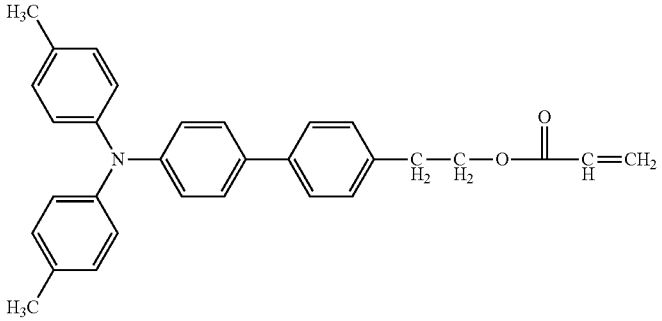

(b)

| | |
|---|---|
| Photopolymerization initiator<br>1-hydroxy-cyclohexyl-phenyl-ketone (Irgacure 184, from Ciba Specialty Chemicals) | 0.5 parts |
| Inorganic particulate material<br>Silica KMPX100 from Shin-Etsu Chemical Co., Ltd. | 2 parts |
| Tetrahydrofuran | 100 parts |

Photoreceptor 4

The procedure for preparation of the photoreceptor 1 was repeated to prepare a photoreceptor 4 except for replacing the CTM (A) in the CTL with the CTM having the formula (B) and the crosslinked surface layer coating liquid 1 with a crosslinked surface layer coating liquid 4 having the following formulation.

Crosslinked Surface Layer Coating Liquid 4

| | |
|---|---|
| Radical polymerizable monomer having no charge transportability and the formula (II) | 6 parts |
| Radical polymerizable monomer having no charge transportability and the formula (III) | 6 parts |
| Radical polymerizable compound having charge transportability and the formula (b). | 10 parts |
| Photopolymerization initiator<br>1-hydroxy-cyclohexyl-phenyl-ketone (Irgacure 184, from Ciba Specialty Chemicals) | 0.5 parts |
| Inorganic particulate material<br>(Alumina AA-03 from Sumitomo Chemical Co., Ltd.) | 2 parts |
| Tetrahydrofuran | 100 parts |

Photoreceptor 5

The procedure for preparation of the photoreceptor 1 was repeated to prepare a photoreceptor 5 except for replacing the CTM (A) in the CTL with the CTM having the formula (B) and the crosslinked surface layer coating liquid 1 with a crosslinked surface layer coating liquid 5 having the following formulation.

Crosslinked Surface Layer Coating Liquid 5

| | |
|---|---|
| Radical polymerizable monomer having no charge transportability and the formula (I) | 10 parts |
| Radical polymerizable compound having charge transportability and the formula (b) | 10 parts |

-continued

| | |
|---|---|
| Photopolymerization initiator<br>1-hydroxy-cyclohexyl-phenyl-ketone (Irgacure 184, from Ciba Specialty Chemicals) | 0.5 parts |
| Inorganic particulate material<br>(Alumina AA-03 from Sumitomo Chemical Co., Ltd.) | 2 parts |
| Tetrahydrofuran | 100 parts |

Photoreceptor 6

The procedure for preparation of the photoreceptor 1 was repeated to prepare a photoreceptor 6 except for replacing the CTM (A) in the CTL with the CTM having the following formula (B) and the crosslinked surface layer coating liquid 1 with a crosslinked surface layer coating liquid 6 having the following formulation.

Crosslinked Surface Layer Coating Liquid 6

| | |
|---|---|
| Radical polymerizable monomer having no charge transportability and the formula (II) | 8 parts |
| Radical polymerizable compound having charge transportability and the formula (b) | 10 parts |
| Photopolymerization initiator<br>1-hydroxy-cyclohexyl-phenyl-ketone (Irgacure 184, from Ciba Specialty Chemicals) | 0.5 parts |
| Tetrahydrofuran | 100 parts |

Photoreceptor 7

The procedure for preparation of the photoreceptor 1 was repeated to prepare a photoreceptor 7 except for replacing the crosslinked surface layer coating liquid 1 with a crosslinked surface layer coating liquid 7 having the following formulation.

Crosslinked Surface Layer Coating Liquid 7

| | |
|---|---|
| Radical polymerizable monomer having no charge transportability and the formula (II) | 4 parts |
| Radical polymerizable monomer having no charge transportability and the formula (III) | 4 parts |
| Radical polymerizable compound having charge transportability and the formula (b). | 10 parts |
| Photopolymerization initiator 1-hydroxy-cyclohexyl-phenyl-ketone (Irgacure 184, from Ciba Specialty Chemicals) | 0.5 parts |
| Tetrahydrofuran | 100 parts |

Photoreceptor 8

The procedure for preparation of the photoreceptor 1 was repeated to prepare a photoreceptor 8 except for replacing the crosslinked surface layer coating liquid 1 with a crosslinked surface layer coating liquid 8 having the following formulation.

Crosslinked Surface Layer Coating Liquid 8

| | |
|---|---|
| Radical polymerizable monomer having no charge transportability and the formula (III) | 12 parts |
| Radical polymerizable compound having charge transportability and the formula (b). | 10 parts |
| Photopolymerization initiator 1-hydroxy-cyclohexyl-phenyl-ketone (Irgacure 184, from Ciba Specialty Chemicals) | 0.5 parts |
| Tetrahydrofuran | 100 parts |

Photoreceptor 9

The procedure for preparation of the photoreceptor 1 was repeated to prepare a photoreceptor 9 except for changing the thickness of the CTL from 22 to 27 μm and forming no surface layer.

TABLE 2

| | Hardness ($N/mm^2$) | Elastic Power Ratio (%) |
|---|---|---|
| Photoreceptor 1 | 195 | 45.7 |
| Photoreceptor 2 | 173 | 38.6 |
| Photoreceptor 3 | 185 | 51.1 |
| Photoreceptor 4 | 170 | 40.5 |
| Photoreceptor 5 | 188 | 47.3 |
| Photoreceptor 6 | 192 | 53.2 |
| Photoreceptor 7 | 178 | 46.6 |
| Photoreceptor 8 | 167 | 37.2 |
| Photoreceptor 9 | 184 | 36.8 |

Three hundred thousands (300,000) images were produced by iPSiO SP C811 with a combination of the cleaning blade and the photoreceptor (OPC) shown in Table 3.

Sheet: My Paper A4 from NBS Ricoh Co., Ltd.

Color: Black

Image Area Ratio: 0, 10 and 50% (different image area ratios in the same chart)

TABLE 3

| | Blade | OPC |
|---|---|---|
| Example 1 | 3 | 1 |
| Example 2 | 4 | 2 |
| Example 3 | 5 | 3 |
| Example 4 | 6 | 4 |
| Example 5 | 11 | 5 |
| Example 6 | 12 | 1 |
| Example 7 | 13 | 2 |
| Example 8 | 14 | 3 |

TABLE 3-continued

| | Blade | OPC |
|---|---|---|
| Example 9 | 16 | 4 |
| Example 10 | 17 | 5 |
| Example 11 | 19 | 1 |
| Example 12 | 20 | 2 |
| Example 13 | 21 | 3 |
| Example 14 | 22 | 4 |
| Example 15 | 23 | 5 |
| Example 16 | 1 | 1 |
| Example 17 | 2 | 2 |
| Example 18 | 7 | 3 |
| Example 19 | 8 | 4 |
| Example 20 | 9 | 5 |
| Example 21 | 10 | 1 |
| Example 22 | 15 | 2 |
| Example 23 | 15 | 3 |
| Example 24 | 18 | 4 |
| Example 25 | 18 | 5 |
| Example 26 | 5 | 6 |
| Example 27 | 5 | 7 |
| Example 28 | 1 | 6 |
| Example 29 | 1 | 7 |
| Example 30 | 15 | 6 |
| Example 31 | 15 | 7 |
| Example 32 | 5 | 8 |
| Example 33 | 12 | 8 |
| Example 34 | 1 | 8 |
| Example 35 | 8 | 8 |
| Example 36 | 15 | 8 |
| Example 37 | 18 | 8 |
| Example 38 | 30 | 7 |
| Example 39 | 30 | 8 |
| Example 40 | 31 | 7 |
| Example 41 | 31 | 8 |
| Example 42 | 32 | 8 |
| Example 43 | 33 | 8 |
| Example 44 | 34 | 8 |
| Example 45 | 35 | 8 |
| Comparative Example 1 | 24 | 4 |
| Comparative Example 2 | 25 | 4 |
| Comparative Example 3 | 26 | 4 |
| Comparative Example 4 | 27 | 4 |
| Comparative Example 5 | 28 | 4 |
| Comparative Example 6 | 29 | 4 |
| Comparative Example 7 | 24 | 5 |
| Comparative Example 8 | 25 | 5 |
| Comparative Example 9 | 26 | 5 |
| Comparative Example 10 | 27 | 5 |
| Comparative Example 11 | 28 | 5 |
| Comparative Example 12 | 29 | 5 |
| Comparative Example 13 | 5 | 9 |
| Comparative Example 14 | 24 | 9 |
| Comparative Example 15 | 27 | 9 |
| Comparative Example 16 | 28 | 9 |
| Comparative Example 17 | 30 | 4 |
| Comparative Example 18 | 31 | 4 |
| Comparative Example 19 | 32 | 4 |
| Comparative Example 20 | 33 | 4 |

Cleanability of Cleaning Blade

After 20 copies of an original image having three horizontal stripe images each having a width of 43 mm were produced, the stripe images were visually observed to determine whether the cleaning blade causes defective cleaning.

Blade Surface Observation

The surface of the blade was visually and with a microscope VHX-100 from Keyence Corporation.

Figure 6:
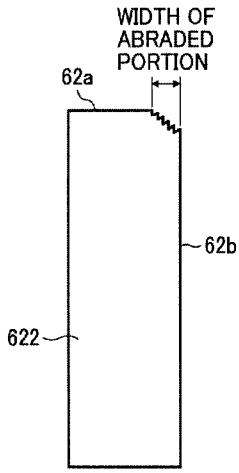
FIG. 6 is a schematic view for explaining the way to determine width of an abraded portion of an elastic blade.
Figure 7A:
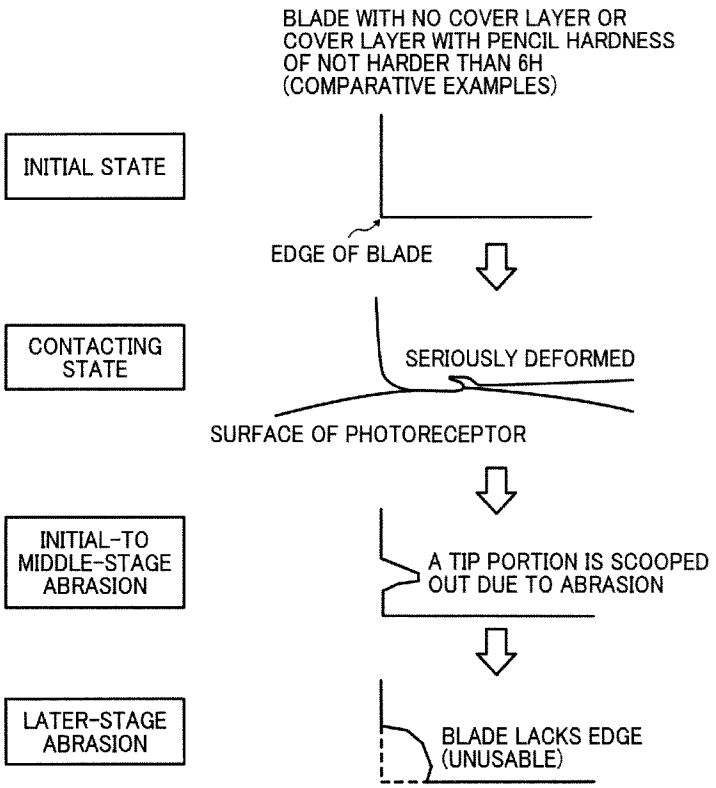
FIGS. 7A and 7B are schematic views for explaining differences between a cleaning blade of this disclosure and a comparative cleaning blade.
Figure 7B:
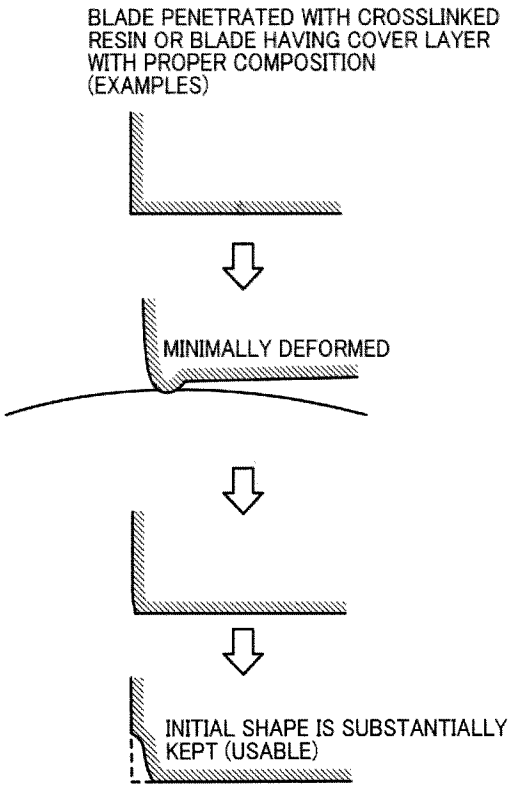

As FIG. 6 shows, an abrasion width of the blade edge was measured from the cross-section of an elastic blade similarly coated with a microscope VHX-100 from Keyence Corporation. The sample was cut by a trimming knife from Nisshin EM Corp.

The Blade Fluttering Sound

Sounds while the images were ordinarily produced were heard.

Photoreceptor Abrasion

The thickness of random 5 points of the photoreceptor were measured by a Fischerscope eddy current film thickness meter.

The results are shown in Tables 4 and 5.

TABLE 4

| | Clean ability | | Blade | Surface layer | Blade Abrasion (μm) | | Blade Sound | |
|---|---|---|---|---|---|---|---|---|
| | 15K | 30K | Crack | peeling | 15K | 30K | 15K | 30K |
| Example 1 | Good | Good | Good | Good | 21 | 40 | Good | Good |
| Example 2 | Good | Good | Good | Good | 20 | 38 | Good | Good |
| Example 3 | Good | Good | Good | Good | 19 | 38 | Good | Good |
| Example 4 | Good | Good | Good | Good | 16 | 34 | Good | Good |
| Example 5 | Good | Good | Good | Good | 23 | 44 | Good | Good |
| Example 6 | Good | Good | Good | Good | 21 | 47 | Good | Good |
| Example 7 | Good | Good | Good | Good | 22 | 52 | Good | Good |
| Example 8 | Good | Good | Good | Good | 18 | 35 | Good | Good |
| Example 9 | Good | Good | Good | Good | 18 | 40 | Good | Good |
| Example 10 | Good | Good | Good | Good | 18 | 36 | Good | Good |
| Example 11 | Good | Good | Good | Good | 22 | 43 | Good | Good |
| Example 12 | Good | Good | Good | Good | 21 | 41 | Good | Good |
| Example 13 | Good | Good | Good | Good | 18 | 40 | Good | Good |
| Example 14 | Good | Good | Good | Good | 18 | 40 | Good | Good |
| Example 15 | Good | Good | Good | Good | 23 | 45 | Good | Good |
| Example 16 | Good | Fair | Good | Good | 21 | 46 | Good | Good |
| Example 17 | Good | Fair | Good | Good | 22 | 51 | Good | Good |
| Example 18 | Good | Good | Good | Fair | 18 | 34 | Good | Good |
| Example 19 | Good | Good | Good | Fair | 18 | 40 | Good | Good |
| Example 20 | Good | Good | Fair | Fair | 30 | 69 | Good | Good |
| Example 21 | Good | Good | Fair | Fair | 22 | 42 | Good | Fair |
| Example 22 | Good | Fair | Good | Good | 27 | 62 | Good | Good |
| Example 23 | Good | Fair | Good | Good | 34 | 65 | Good | Good |
| Example 24 | Good | Good | Good | Fair | 38 | 87 | Good | Good |
| Example 25 | Good | Good | Good | Fair | 21 | 48 | Good | Good |
| Example 26 | Good | Good | Good | Good | 24 | 48 | Good | Good |
| Example 27 | Good | Fair | Good | Good | 20 | 38 | Good | Fair |
| Example 28 | Good | Fair | Good | Good | 20 | 44 | Good | Fair |
| Example 29 | Good | Fair | Good | Good | 23 | 44 | Fair | Fair |
| Example 30 | Good | Fair | Good | Good | 28 | 64 | Good | Good |
| Example 31 | Good | Fair | Good | Good | 35 | 77 | Fair | Fair |
| Example 32 | Good | Good | Good | Good | 18 | 38 | Good | Fair |
| Example 33 | Good | Good | Good | Good | 24 | 46 | Good | Fair |
| Example 34 | Good | Fair | Good | Good | 23 | 48 | Good | Good |
| Example 35 | Good | Good | Good | Fair | 24 | 53 | Good | Fair |
| Example 36 | Good | Fair | Good | Fair | 31 | 70 | Good | Good |
| Example 37 | Good | Good | Good | Fair | 39 | 89 | Good | Fair |
| Example 38 | Good | Good | Good | Good | 13 | 25 | Good | Good |
| Example 39 | Good | Good | Good | Good | 11 | 26 | Good | Good |
| Example 40 | Good | Good | Good | Good | 15 | 31 | Good | Good |
| Example 41 | Good | Good | Good | Good | 18 | 33 | Good | Good |
| Example 42 | Good | Good | Good | Good | 16 | 30 | Good | Good |
| Example 43 | Good | Good | Good | Good | 21 | 45 | Good | Good |
| Example 44 | Good | Good | Good | Good | 28 | 53 | Good | Good |
| Example 45 | Good | Good | Good | Good | 18 | 40 | Good | Good |
| Comparative Example 1 | Fair | Poor | Poor | Poor | 107 | 243 | Good | Good |

TABLE 4-continued

| | Clean ability | | Blade | Surface layer | Blade Abrasion (μm) | | Blade Sound | |
|---|---|---|---|---|---|---|---|---|
| | 15K | 30K | Crack | peeling | 15K | 30K | 15K | 30K |
| Comparative Example 2 | Fair | Poor | Poor | Poor | 98 | 174 | Good | Fair |
| Comparative Example 3 | Poor | Poor | Poor | Poor | 88 | 174 | Fair | Poor |
| Comparative Example 4 | Fair | Fair | Poor | Poor | 45 | 103 | Good | Fair |
| Comparative Example 5 | Poor | — | — | — | 367 | — | Poor | — |
| Comparative Example 6 | Poor | — | — | — | 382 | — | Poor | — |
| Comparative Example 7 | Good | Poor | Poor | Poor | 63 | 134 | Fair | Fair |
| Comparative Example 8 | Poor | Poor | Poor | Poor | 165 | 352 | Fair | Fair |
| Comparative Example 9 | Fair | Poor | Poor | Poor | 113 | 251 | Good | Poor |
| Comparative Example 10 | Fair | Poor | Poor | Poor | 182 | 383 | Fair | Fair |
| Comparative Example 11 | Poor | — | — | — | 371 | — | Poor | — |
| Comparative Example 12 | Poor | — | — | — | 374 | — | Poor | — |
| Comparative Example 13 | — | — | — | — | — | — | — | — |
| Comparative Example 14 | Fair | — | — | — | 172 | — | Poor | — |
| Comparative Example 15 | — | — | — | — | — | — | — | — |
| Comparative Example 16 | — | — | — | — | — | — | — | — |
| Comparative Example 17 | Fair | Poor | Poor | Poor | 85 | 159 | Good | Good |
| Comparative Example 18 | Poor | Poor | Poor | Poor | 75 | 182 | Good | Good |
| Comparative Example 19 | Fair | Poor | Poor | Poor | 121 | 253 | Good | Good |
| Comparative Example 20 | Poor | Poor | Poor | Poor | 103 | 224 | Good | Good |

(Cleanability)
Good: Not contaminated
Fair: Edge contaminated
Poor: Totally contaminated
(Blade sound)
Good: No sound
Fair: Occasional
Poor: Constant
(Blade Crack)
Good: Not cracked
Fair: Slightly cracked
Poor: Totally cracked
(Surface Layer Peeling)
Good: Not peeled
Fair: Edge peeled
Poor: Totally peeled

TABLE 5

| | Photo receptor abrasion (μm) | | | | | | | | |
|---|---|---|---|---|---|---|---|---|---|
| | 5K | | | 15K | | | 30K | | |
| | 0% | 10% | 50% | 0% | 10% | 50% | 0% | 10% | 50% |
| Example 1 | 0.28 | 0.31 | 0.31 | 0.70 | 0.77 | 0.77 | 1.61 | 1.77 | 1.77 |
| Example 2 | 0.23 | 0.23 | 0.26 | 0.67 | 0.67 | 0.77 | 1.37 | 1.37 | 1.57 |
| Example 3 | 0.21 | 0.22 | 0.25 | 0.50 | 0.53 | 0.60 | 1.06 | 1.12 | 1.27 |
| Example 4 | 0.24 | 0.26 | 0.30 | 0.74 | 0.82 | 0.93 | 1.64 | 180 | 2.05 |
| Example 5 | 0.26 | 0.28 | 0.33 | 0.73 | 0.80 | 0.94 | 1.45 | 1.60 | 1.89 |
| Example 6 | 0.28 | 0.32 | 0.34 | 0.85 | 0.98 | 1.07 | 1.95 | 2.24 | 2.43 |
| Example 7 | 0.23 | 0.25 | 0.30 | 0.66 | 0.69 | 0.85 | 1.41 | 1.48 | 1.83 |

TABLE 5-continued

| | Photo receptor abrasion (μm) | | | | | | | | |
|---|---|---|---|---|---|---|---|---|---|
| | 5K | | | 15K | | | 30K | | |
| | 0% | 10% | 50% | 0% | 10% | 50% | 0% | 10% | 50% |
| Example 8 | 0.23 | 0.23 | 0.27 | 0.56 | 0.56 | 0.65 | 1.29 | 1.29 | 1.49 |
| Example 9 | 0.24 | 0.26 | 0.29 | 0.71 | 0.75 | 0.85 | 1.46 | 1.54 | 1.75 |
| Example 10 | 0.21 | 0.24 | 0.24 | 0.51 | 0.57 | 0.57 | 1.08 | 1.19 | 1.19 |
| Example 11 | 0.23 | 0.26 | 0.30 | 0.73 | 0.80 | 0.95 | 1.60 | 1.76 | 2.08 |
| Example 12 | 0.30 | 0.34 | 0.37 | 0.86 | 0.99 | 1.07 | 1.72 | 1.97 | 2.14 |
| Example 13 | 0.31 | 0.32 | 0.34 | 0.95 | 1.00 | 1.04 | 2.16 | 2.27 | 2.38 |
| Example 14 | 0.18 | 0.18 | 0.24 | 0.53 | 0.53 | 0.69 | 1.14 | 1.14 | 1.48 |
| Example 15 | 0.17 | 0.18 | 0.22 | 0.42 | 0.44 | 0.52 | 0.96 | 1.01 | 1.20 |
| Example 16 | 0.27 | 0.31 | 0.34 | 0.84 | 0.96 | 1.05 | 1.91 | 2.19 | 2.39 |
| Example 17 | 0.23 | 0.24 | 0.30 | 0.64 | 0.68 | 0.84 | 1.38 | 1.45 | 1.79 |
| Example 18 | 0.23 | 0.23 | 0.26 | 0.55 | 0.55 | 0.63 | 1.27 | 1.27 | 1.46 |
| Example 19 | 0.24 | 0.25 | 0.29 | 0.70 | 0.74 | 0.84 | 1.43 | 1.51 | 1.71 |
| Example 20 | 0.21 | 0.23 | 0.23 | 0.50 | 0.55 | 0.55 | 1.06 | 1.16 | 1.16 |
| Example 21 | 0.23 | 0.25 | 0.30 | 0.71 | 0.78 | 0.93 | 1.57 | 1.73 | 2.04 |
| Example 22 | 0.29 | 0.33 | 0.36 | 0.84 | 0.97 | 1.05 | 1.68 | 1.93 | 2.10 |
| Example 23 | 0.30 | 0.32 | 0.33 | 0.93 | 0.98 | 1.02 | 2.12 | 2.23 | 2.33 |
| Example 24 | 0.18 | 0.18 | 0.23 | 0.52 | 0.52 | 0.68 | 1.12 | 1.12 | 1.45 |
| Example 25 | 0.17 | 0.18 | 0.21 | 0.41 | 0.43 | 0.51 | 0.94 | 0.99 | 1.17 |
| Example 26 | 0.22 | 0.24 | 0.24 | 0.64 | 0.70 | 0.70 | 1.31 | 1.44 | 1.44 |
| Example 27 | 0.25 | 0.28 | 0.33 | 0.78 | 0.85 | 1.01 | 1.63 | 1.79 | 2.12 |
| Example 28 | 0.26 | 0.30 | 0.31 | 0.75 | 0.87 | 0.90 | 1.66 | 1.91 | 1.99 |
| Example 29 | 0.41 | 0.53 | 0.47 | 1.35 | 1.76 | 1.56 | 2.71 | 3.52 | 3.11 |
| Example 30 | 0.40 | 0.40 | 0.46 | 1.24 | 1.25 | 1.43 | 2.83 | 2.86 | 3.25 |
| Example 31 | 0.45 | 0.50 | 0.59 | 1.37 | 1.51 | 1.78 | 2.94 | 3.23 | 3.82 |
| Example 32 | 0.44 | 0.53 | 0.57 | 1.41 | 1.69 | 1.83 | 3.24 | 3.89 | 4.21 |
| Example 33 | 0.48 | 0.55 | 0.62 | 1.56 | 1.79 | 2.03 | 3.20 | 3.68 | 4.16 |
| Example 34 | 0.47 | 0.61 | 0.52 | 1.43 | 1.86 | 1.58 | 3.01 | 3.91 | 3.31 |
| Example 35 | 0.46 | 0.46 | 0.60 | 1.56 | 1.58 | 2.03 | 3.44 | 3.48 | 4.47 |
| Example 36 | 0.44 | 0.48 | 0.53 | 1.46 | 1.61 | 1.75 | 2.92 | 3.21 | 3.51 |
| Example 37 | 0.48 | 0.58 | 0.59 | 1.50 | 1.80 | 1.73 | 3.43 | 4.11 | 4.35 |
| Example 38 | 0.11 | 0.17 | 0.22 | 0.43 | 0.52 | 0.60 | 0.81 | 1.05 | 1.53 |
| Example 39 | 0.14 | 0.25 | 0.30 | 0.48 | 0.72 | 0.91 | 1.05 | 1.52 | 2.25 |
| Example 40 | 0.13 | 0.23 | 0.35 | 0.35 | 0.58 | 1.05 | 0.72 | 1.23 | 2.41 |
| Example 41 | 0.16 | 0.30 | 0.39 | 0.40 | 0.55 | 0.82 | 0.78 | 1.11 | 1.92 |
| Example 42 | 0.11 | 0.16 | 0.25 | 0.32 | 0.46 | 0.78 | 0.68 | 0.95 | 1.71 |
| Example 43 | 0.08 | 0.15 | 0.36 | 0.21 | 0.42 | 0.99 | 0.45 | 0.95 | 2.58 |
| Example 44 | 0.15 | 0.25 | 0.43 | 0.46 | 0.71 | 1.05 | 1.23 | 1.94 | 2.76 |
| Example 45 | 0.12 | 0.21 | 0.30 | 0.35 | 0.60 | 0.88 | 0.68 | 1.33 | 2.14 |
| Comparative Example 1 | 0.21 | 0.23 | 0.27 | 0.61 | 0.67 | 0.79 | 1.30 | 1.43 | 1.69 |
| Comparative Example 2 | 0.41 | 0.43 | 0.53 | 0.98 | 1.04 | 1.28 | 1.97 | 2.09 | 2.56 |
| Comparative Example 3 | 0.21 | 0.21 | 0.23 | 0.50 | 0.50 | 0.55 | 1.03 | 1.03 | 1.14 |
| Comparative Example 4 | 0.44 | 0.48 | 0.55 | 1.36 | 1.50 | 1.71 | 3.11 | 3.42 | 3.89 |
| Comparative Example 5 | 0.23 | 0.24 | 0.30 | 0.71 | 0.76 | 0.93 | — | — | — |
| Comparative Example 6 | 0.21 | 0.32 | 0.76 | 0.83 | 0.88 | 1.03 | — | — | — |
| Comparative Example 7 | 0.22 | 0.25 | 0.24 | 0.62 | 0.71 | 0.68 | 1.40 | 1.62 | 1.54 |
| Comparative Example 8 | 0.47 | 0.52 | 0.52 | 1.36 | 1.50 | 1.50 | 2.92 | 3.21 | 3.21 |
| Comparative Example 9 | 0.23 | 0.25 | 0.28 | 0.71 | 0.78 | 0.86 | 1.43 | 1.57 | 1.71 |
| Comparative Example 10 | 0.42 | 0.51 | 0.53 | 1.28 | 1.43 | 1.52 | 2.88 | 3.07 | 3.15 |
| Comparative Example 11 | 0.23 | 0.25 | 0.30 | 0.72 | 0.76 | 0.94 | — | — | — |
| Comparative Example 12 | 0.21 | 0.31 | 0.75 | 0.81 | 0.86 | 1.01 | — | — | — |
| Comparative Example 13 | 2.46 | 2.46 | 3.20 | — | — | — | — | — | — |
| Comparative Example 14 | 0.46 | 0.53 | 0.60 | 1.43 | 1.64 | 1.85 | — | — | — |
| Comparative Example 15 | 2.37 | 2.37 | 2.73 | — | — | — | — | — | — |
| Comparative Example 16 | 0.26 | 0.29 | 0.31 | — | — | — | — | — | — |
| Comparative Example 17 | 0.22 | 0.24 | 0.28 | 0.63 | 0.65 | 0.81 | 1.35 | 1.51 | 1.88 |
| Comparative Example 18 | 0.16 | 0.19 | 0.23 | 0.45 | 0.42 | 0.55 | 0.98 | 1.05 | 1.23 |

TABLE 5-continued

| | Photo receptor abrasion (μm) | | | | | | | | |
|---|---|---|---|---|---|---|---|---|---|
| | 5K | | | 15K | | | 30K | | |
| | 0% | 10% | 50% | 0% | 10% | 50% | 0% | 10% | 50% |
| Comparative Example 19 | 0.23 | 0.24 | 0.26 | 0.51 | 0.79 | 1.78 | 1.06 | 1.25 | 2.59 |
| Comparative Example 20 | 0.23 | 0.28 | 0.42 | 0.69 | 0.72 | 1.25 | 2.25 | 3.12 | 3.55 |

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

a photoreceptor;

a charger configured to charge a surface of the photoreceptor;

an irradiator configured to irradiate the surface of the photoreceptor to form an electrostatic latent image thereon;

an image developer configured to develop the electrostatic latent image with a toner to form a toner image;

a transferer configured to transfer the toner image onto a recording medium;

a fixer configured to fix the toner image on the recording medium; and a cleaning blade formed of a strip-shaped elastic blade, configured to remove a powder from the surface of the photoreceptor passing an edge line of the blade while contacting thereto, wherein the photoreceptor comprises a crosslinked resin surface layer formed of at least one of an acrylic resin and a methacrylic resin, and the cleaning blade comprises a contact point with the photoreceptor, comprising:

a substrate;

a mixed layer formed of at least one of an acrylic resin and a methacrylic resin, located at the surface of the substrate; and a surface layer formed of at least one of an acrylic resin and a methacrylic resin, located on the surface of the substrate, wherein the crosslinked resin surface layer of the photoreceptor has a Martens hardness from 167 $N/mm^2$ to 195 $N/mm^2$.

2. The image forming apparatus of claim 1, wherein the surface layer of the cleaning blade has a thickness of from 0.5 to 1.0 μm.

3. The image forming apparatus of claim 1, wherein the mixed layer of the cleaning blade has a thickness of from 10 to 30 μm.

4. The image forming apparatus of claim 1, wherein the crosslinked resin surface layer of the photoreceptor has an elastic power ratio (We/Wt value) not less than 38.0%.

5. The image forming apparatus of claim 1, wherein the crosslinked resin surface layer of the photoreceptor comprises a particulate material.

6. The image forming apparatus of claim 1, wherein the surface layer of the cleaning blade comprises a fluorine-containing resin.

7. A process cartridge, comprising at least a photoreceptor and one of a charger, an irradiator, an image developer, a transferer, a cleaner and a discharger, wherein the photoreceptor and the cleaner are the photoreceptor and the strip-shaped elastic cleaning blade according to claim 1, respectively.

* * * * *